US010098515B2

(12) United States Patent
Park et al.

(10) Patent No.: US 10,098,515 B2
(45) Date of Patent: Oct. 16, 2018

(54) VACUUM CLEANER

(71) Applicant: SAMSUNG ELECTRONICS CO., LTD., Suwon-si, Gyeonggi-do (KR)

(72) Inventors: Tae Sang Park, Suwon-si (KR); Myung Bae Bang, Pyeongtaek-si (KR); Kwang Soo Kim, Seoul (KR); Jong Jin Park, Suwon-si (KR); Hyeon Joon Oh, Gwangju (KR); Seung Yeol Lee, Suwon-si (KR); Byung Ryel In, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 389 days.

(21) Appl. No.: 14/695,223

(22) Filed: Apr. 24, 2015

(65) Prior Publication Data

US 2016/0037984 A1 Feb. 11, 2016

(30) Foreign Application Priority Data

Aug. 11, 2014 (KR) ..... 10-2014-0103133

(51) Int. Cl.
*A47L 9/00* (2006.01)
*A47L 5/22* (2006.01)
(Continued)

(52) U.S. Cl.
CPC ..... *A47L 9/0081* (2013.01); *A47L 5/22* (2013.01); *A47L 5/225* (2013.01); *F04D 25/08* (2013.01);
(Continued)

(58) Field of Classification Search
None
See application file for complete search history.

(56) References Cited

U.S. PATENT DOCUMENTS 5,110,266 A 5/1992 Toyoshima et al.
2007/0122276 A1 5/2007 Oh et al.
(Continued)

FOREIGN PATENT DOCUMENTS

CN 103491837 1/2014
JP 59-41700 3/1984
(Continued)

OTHER PUBLICATIONS

International Search Report dated Jul. 22, 2015 from International Patent Application No. PCT/KR2015/003735, 3 pages.
(Continued)

*Primary Examiner* — Joseph J Hail
*Assistant Examiner* — Brian D Keller
(74) *Attorney, Agent, or Firm* — Staas & Halsey LLP

(57) ABSTRACT

A vacuum cleaner having an improved structure capable of enhancing suction performance includes a suction unit provided in a main body, the suction unit including an impeller disposed to suck air by rotating about an axis thereof, and a diffuser disposed to guide air discharged from the impeller. The diffuser includes an inner casing, an outer casing disposed to be spaced apart from an outer circumference of the inner casing and to form a path through which the air discharged from the impeller flows, and a plurality of vanes disposed at the inner casing to guide the air discharged from the impeller to the path, and the plurality of vanes protrude toward the outer casing to cross at least a part of the path.

23 Claims, 25 Drawing Sheets

(51) Int. Cl.

| | |
|---|---|
| ***F04D 29/44*** | (2006.01) |
| ***F04D 25/08*** | (2006.01) |
| ***F04D 29/42*** | (2006.01) |
| ***F04D 29/62*** | (2006.01) |

(52) U.S. Cl.
CPC ..... *F04D 29/4253* (2013.01); *F04D 29/444* (2013.01); *F04D 29/626* (2013.01)

(56) References Cited

U.S. PATENT DOCUMENTS

| | | | |
|---|---|---|---|
| 2008/0014080 | A1 | 1/2008 | Fang |
| 2008/0050252 | A1 | 2/2008 | Ahn |
| 2010/0209271 | A1 | 8/2010 | Yoo |
| 2010/0215489 | A1 | 8/2010 | Johnson |
| 2014/0147311 | A1 | 5/2014 | Jung et al. |

FOREIGN PATENT DOCUMENTS

| | | |
|---|---|---|
| JP | 2013-32749 | 2/2013 |
| WO | 2013/053920 | 4/2013 |

OTHER PUBLICATIONS

Extended European Search Report dated Jul. 31, 2017 in European Patent Application No. 15831935.0.
Australian Office Action dated Sep. 26, 2017 in Australian Patent Application No. 2015302568.
Australian Notice of Acceptance for Patent Application dated Feb. 23, 2018 in Australian Patent Application No. 2015302568.
Chinese Office Action dated Aug. 31, 2018 in Chinese Patent Application No. 201580043483.6.

VACUUM CLEANER

CROSS-REFERENCE TO RELATED APPLICATIONS

This application claims the priority benefit of Korean Patent Application No. 10-2014-0103133, filed on Aug. 11, 2014 in the Korean Intellectual Property Office, the disclosure of which is incorporated herein by reference.

BACKGROUND

1. Field

Embodiments of the disclosure relate to a vacuum cleaner, and more particularly, to a vacuum cleaner having an improved structure which is capable of enhancing suction performance.

2. Description of the Related Art

In general, a cleaner refers to an apparatus which sucks air including dust on a surface to be cleaned, separates and collects the dust from the air, and then discharges purified air to an outside of a main body.

The cleaner may include an impeller and a diffuser which are structural elements determining a suction force.

The air sucked into the main body passes through the impeller and the diffuser, in turn, along a path which is bent a few times. In this process, a pressure loss of the air is increased, and thus the impeller and the diffuser are designed to have a small distance therebetween and to compensate for a reduction in the suction force due to the pressure loss. However, as the distance between the impeller and the diffuser is small, noise may be generated due to pressure perturbation. To prevent the noise, sizes of the impeller and a motor coupled to the impeller may be increased. However, in this case, since a size of the cleaner is also increased, it does not meet a recent market trend requiring a compact product.

In particular, since a small-sized cleaner such as a hand-held type cleaner may not generally use a high-power suction motor, a reduction in suction efficiency due to the pressure loss or a flow loss may be increased.

SUMMARY

Additional aspects and/or advantages will be set forth in part in the description which follows and, in part, will be apparent from the description, or may be learned by practice of the disclosure.

Therefore, it is an aspect of the disclosure to provide a vacuum cleaner having an improved structure which is capable of having a small or compact size.

It is an aspect of the disclosure to provide a vacuum cleaner having an improved structure which is capable of having a small or compact size and also enhancing a suction force.

It is an aspect of the disclosure to provide a vacuum cleaner having an improved structure which is capable of preventing noise.

It is an aspect of the disclosure to provide a vacuum cleaner having an improved structure which is capable of enhancing assemblability of a diffuser.

Additional aspects of the disclosure will be set forth in part in the description which follows and, in part, will be apparent from the description, or may be learned by practice of the disclosure.

In accordance with an aspect of the disclosure, a vacuum cleaner may include a suction unit provided in a main body, wherein the suction unit may include an impeller disposed to suck air by rotating about an axis thereof, and a diffuser disposed to guide air discharged from the impeller. The diffuser may include an inner casing, an outer casing disposed to be spaced along an outer circumference of the inner casing to form a path through which the air discharged from the impeller flows, and a plurality of vanes disposed at the inner casing to guide the air discharged from the impeller to the path, and the plurality of vanes may protrude toward the outer casing to cross at least a part of the path.

The plurality of vanes may be disposed so that one ends of the plurality of vanes are connected to the outer casing.

The diffuser may further comprise a plurality of guides disposed on the path and provided between the inner casing and the outer casing.

The plurality of guides may connect the inner casing and the outer casing.

The plurality of guides may extend in an axial direction of the impeller.

The plurality of guides may be disposed to be inclined with respect to the axial direction of the impeller.

The plurality of guides may be disposed in parallel with the axial direction of the impeller.

At least a part of the plurality of guides may include a curved surface.

The plurality of guides may be integrally formed with the plurality of vanes to be located under the plurality of vanes in the axial direction of the impeller.

The plurality of guides may include edge parts located at an upper stream side of the path in a flowing direction of the air discharged from the impeller, and the plurality of vanes may be disposed to be discontinuously located on the edge parts.

The plurality of guides may include edge parts located at an upper stream side of the path in a flowing direction of the air discharged from the impeller, and the plurality of vanes may be disposed on the edge parts to be spaced from the outer casing.

The plurality of guides may include edge parts located at an upper stream side of the path in a flowing direction of the air discharged from the impeller and configured to connect the inner casing and the outer casing, and the plurality of vanes may be disposed to be located on at least a part of the edge parts.

In accordance with an aspect of the disclosure, a vacuum cleaner may include a suction unit provided in a main body, wherein the suction unit may include an impeller disposed to suck air by rotating about an axis thereof, and a diffuser disposed to guide air discharged from the impeller. The diffuser may include an inner casing, an outer casing disposed to be spaced along an outer circumference of the inner casing, a path provided between the inner casing and the outer casing so that the air discharged from the impeller flows therethrough, and a plurality of blades formed integrally with at least one of the inner casing and the outer casing to connect the inner casing and the outer casing.

The plurality of blades may include a plurality of vanes disposed on the inner casing to extend outward in a radial direction of the inner casing.

The path may include an entrance located at an upper stream side in a flowing direction of the air discharged from the impeller, and the plurality of blades may include a plurality of vanes disposed to cross at least a part of the entrance.

The plurality of blades may include a plurality of vanes having bodies disposed between the inner casing and the outer casing in a radial direction of the inner casing, and at least one communication part may be formed at the plurality of vanes.

The at least one communication part may be formed at the bodies located on the path so that air introduced into the path passes therethrough.

The plurality of blades may include a plurality of vanes disposed on the inner casing to protrude outward in the radial direction of the inner casing, and the plurality of vanes may be gradually inclined along a rotating direction of the impeller from the inner casing toward the outer casing.

The plurality of blades may comprise a plurality of guides extended in the axial direction of the impeller to partition the path, and disposed to be coupled with at least one of the inner casing and the outer casing.

The plurality of guides may be gradually inclined along a rotating direction of the impeller from an upper stream side of the path in a flowing direction of the air discharged from the impeller to a lower stream side of the path.

The plurality of blades may include a plurality of vanes disposed on the inner casing to cross at least a part of the path in a radial direction of the inner casing, and a plurality of guides connected to the plurality of vanes so as to be disposed between the inner casing and the outer casing in the axial direction of the impeller, and at least a part of at least one side of the plurality of vanes and the plurality of guides may be formed in a curved surface.

In accordance with an aspect of the disclosure, a suction unit for a cleaning apparatus may include a housing, a motor assembly, disposed in the housing, the motor assembly including a shaft which rotates, an impeller coupled to the shaft and disposed to suck air into the suction unit; and a diffuser disposed about an outer circumference of the impeller. The diffuser may include an inner casing, an outer casing, a diffuser path formed between the inner casing and the outer casing and through which air discharged from the impeller flows, and a plurality of blades which extend from at least one of the inner casing and the outer casing toward one of the outer casing and the inner casing, to cross at least a part of the diffuser path in a radial direction of the inner casing.

The suction unit may further include an air inlet port disposed at an upper portion of the housing through which air is introduced into the housing, and an air outlet port disposed at a lower portion of the housing through which air exits the housing.

The housing may include a first housing disposed at an upper portion of the impeller, in which the air inlet port is provided, a third housing disposed at a lower portion of the impeller, in which the air outlet port is provided, and a second housing disposed between the first housing and third housing, and which is detachably coupled to and from at least one of the first housing and third housing, wherein the second housing corresponds to the outer casing of the diffuser.

The motor assembly may include an upper housing disposed at an upper portion of the shaft, the upper housing including a plurality of coupling holes, a lower housing disposed at a lower portion of the shaft, and a bearing housing to rotatably support an upper portion of the shaft, the bearing housing including a plurality of coupling grooves. The upper housing may be disposed between the diffuser and the bearing housing, and at least a part of the plurality of the blades of the diffuser may pass through the coupling holes of the upper housing to couple with the plurality of coupling grooves of the bearing housing.

The diffuser may be formed of plastic.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
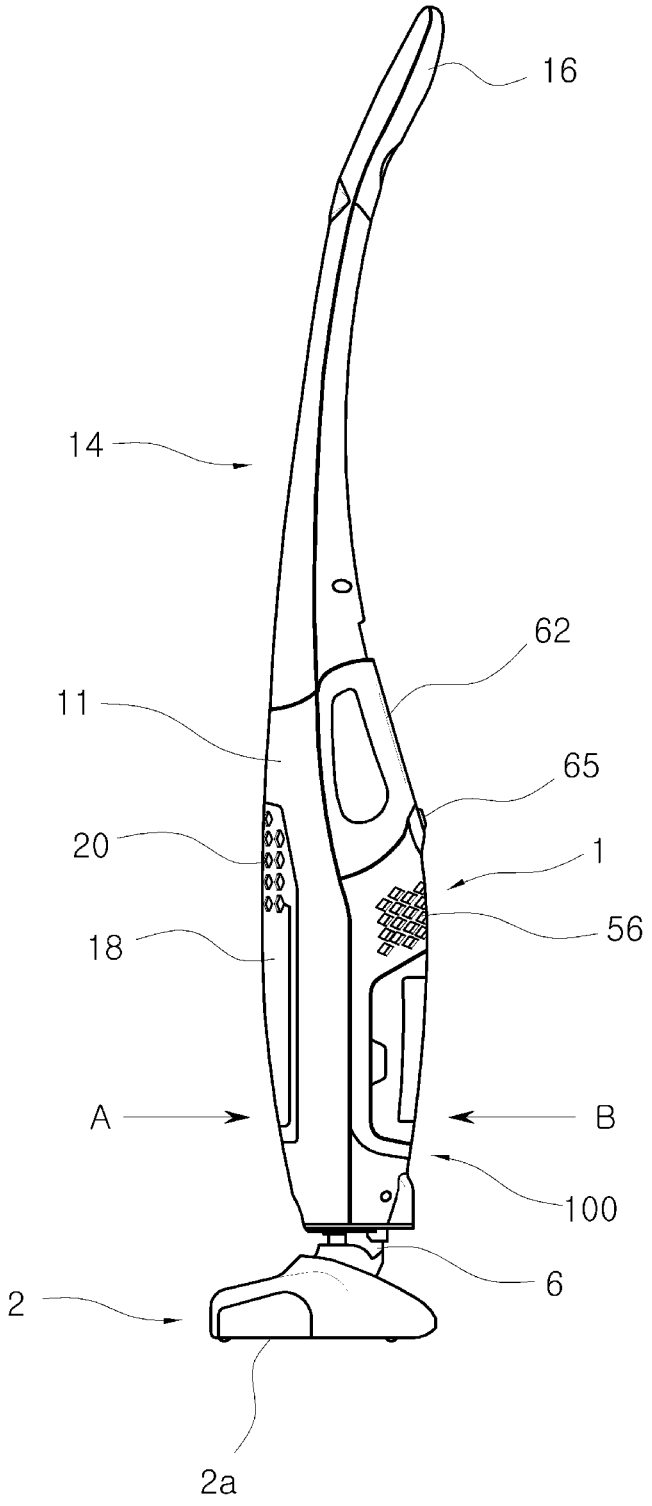
FIG. 1 is a view illustrating a state in which a vacuum cleaner in accordance with an embodiment of the disclosure is coupled to a stick body.

Reference will now be made in detail to embodiments of the disclosure, examples of which are illustrated in the accompanying drawings, wherein like reference numerals refer to like elements throughout. Meanwhile, terms such as "front end", "rear end", "upper", "lower", "upper end" and "lower end" which will be used in the below description are defined based on the drawings, and a shape and a position of each element are not limited by the terms.

Suction units 200 and 200*a* in accordance with the disclosure may be applied to various types of cleaners including a canister type cleaner in which a main body and a suction nozzle are separated from each other and connected with each other through a predetermined pipe, an up-right type cleaner in which the main body and the suction nozzle are provided integrally, a hand-held type cleaner and a robot cleaner. Hereinafter, the disclosure will be described based on the hand-held type cleaner, as an example embodiment.

Figure 2:
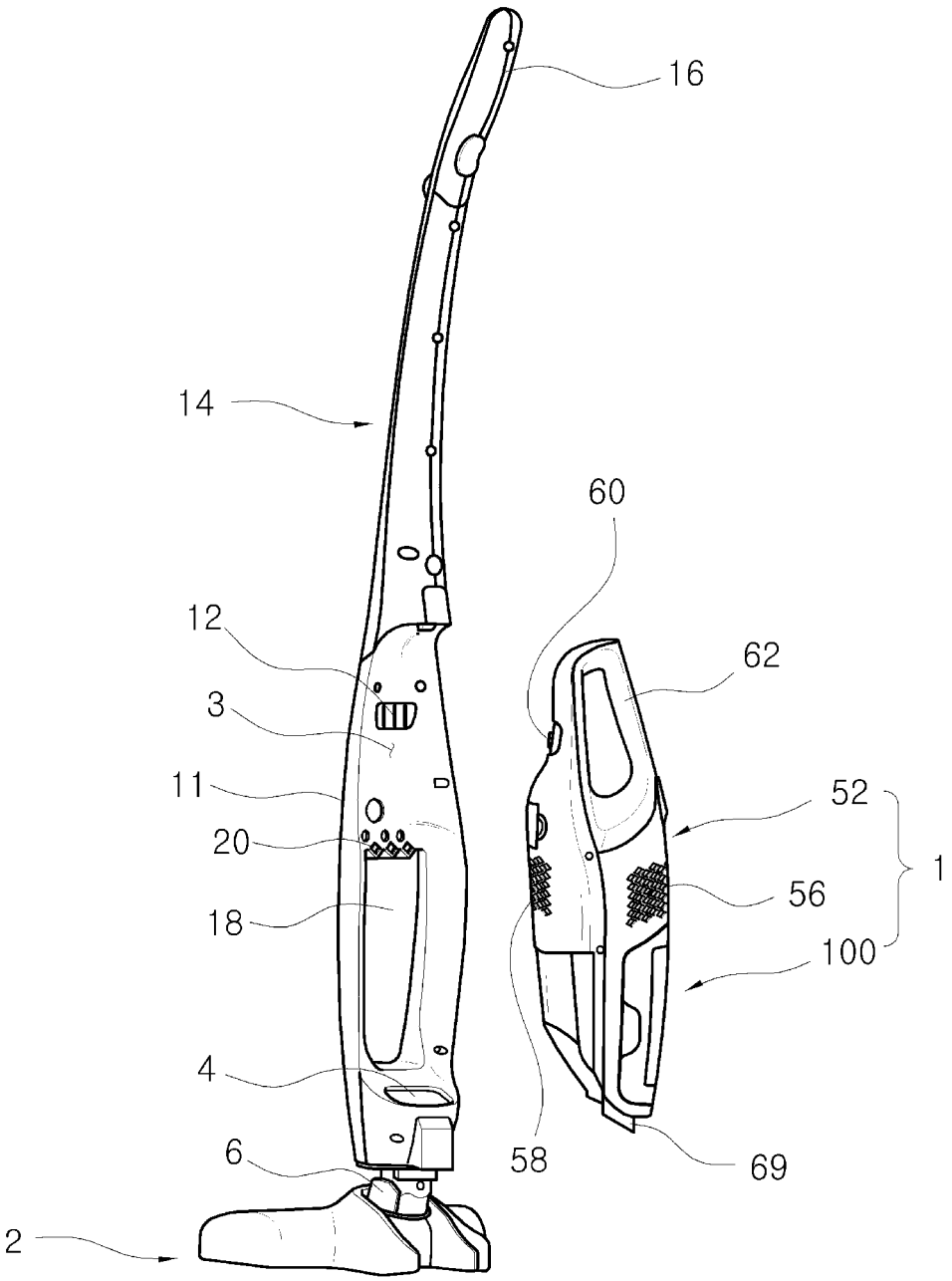
FIG. 2 is a view illustrating a state in which the vacuum cleaner in accordance with an embodiment of the disclosure is separated from the stick body.
Figure 3:
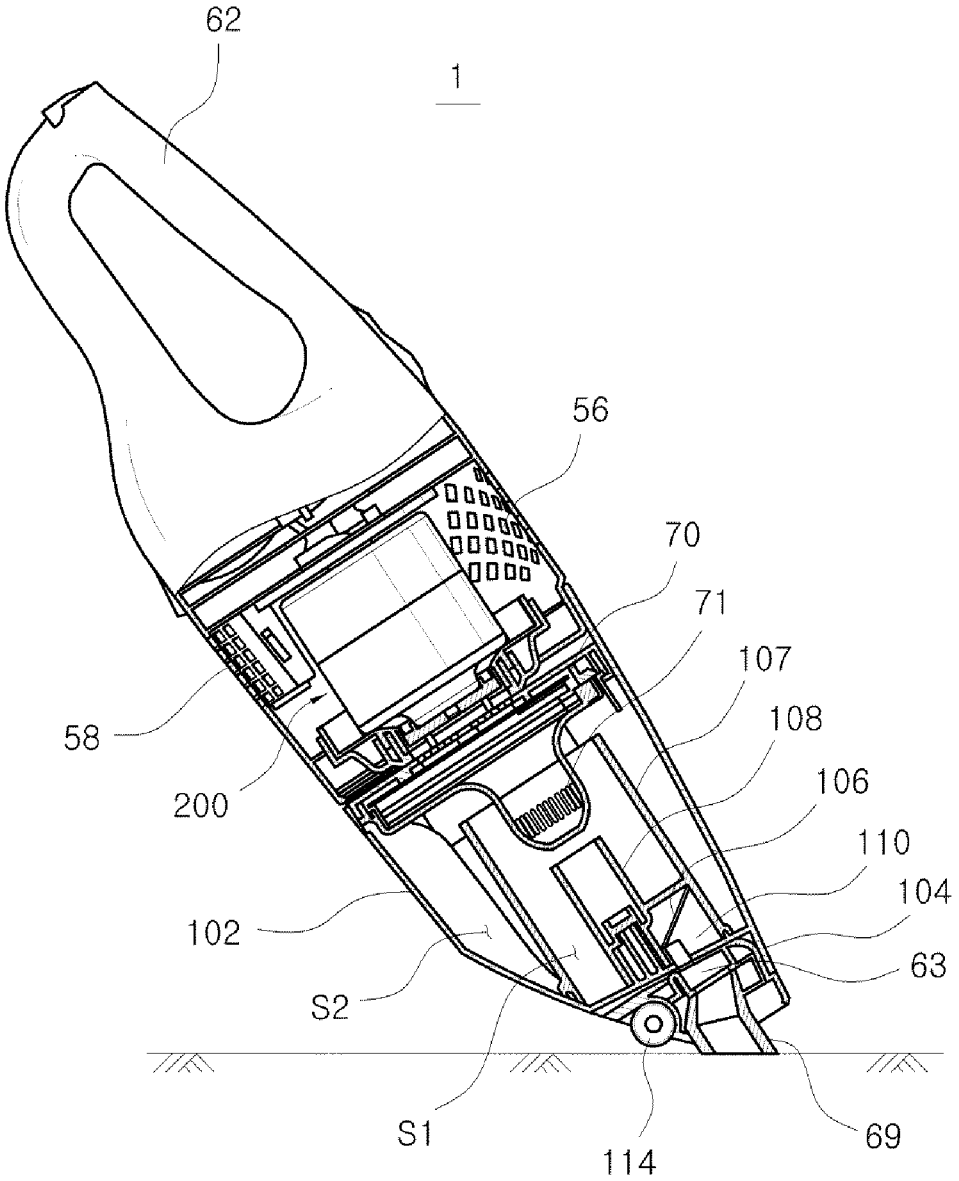
FIG. 3 is a cross-sectional view illustrating the vacuum cleaner in accordance with an embodiment of the disclosure.

FIG. 1 is a view illustrating a state in which a vacuum cleaner in accordance with an embodiment of the disclosure is coupled to a stick body, FIG. 2 is a view illustrating a state in which the vacuum cleaner in accordance with an embodiment of the disclosure is separated from the stick body, and FIG. 3 is a cross-sectional view illustrating the vacuum cleaner in accordance with an embodiment of the disclosure.

As illustrated in FIGS. 1 to 3, the vacuum cleaner 1 may include a main body 52, a suction unit 200 and a dust collector 100.

A grille-type first air exhaust part 56 having a plurality of air exhaust holes, a handle 62 and a power button 65 may be provided at a front surface of the main body 52. The suction unit 200 which generates a suction force and a battery (not shown) may be installed at an inner upper side of the main body 52. A grille-type second air exhaust part 58 having a plurality of air exhaust holes may be formed at a position opposite to the first air exhaust part 56 on a rear surface of the main body 52. A second connection terminal 60 may be formed above the second air exhaust part 58 on the rear surface of the main body 52. A roller 114 may be rotatably installed at a lower end of the main body 52. A cyclone installation space (not shown) in which the cyclone type dust collector 100 is installed may be formed at a lower portion of the main body 52 so as to pass therethrough.

The dust collector 100 is not limited to the cyclone type. However, for convenience of explanation, in accordance with the following discussion the vacuum cleaner 1 includes the cyclone type dust collector 100.

The main body 52 may include an inlet port 63, the roller 114, an inlet gasket (not shown), an outlet gasket (not shown) and a rib 69. The inlet port 63 may be in close contact and coupled with an opening 4 of a stick body 14 and a cyclone entrance 110. The inlet gasket may be installed at a circumferential surface of the inlet port 63 to prevent air from leaking through a coupling portion between the inlet port 63 and the cyclone entrance 110. The outlet gasket may be installed around an air suction port 251 of the suction unit 200 formed above the cyclone installation space to increase a contact force between a filter unit 70 and the main body 52 and thus to prevent the air from leaking through a coupling portion therebetween.

The roller 114 may be installed under the inlet port 63. When the vacuum cleaner 1 is used while separated from the stick body 14, the roller 114 may be in contact with a surface to be cleaned so as to be rotated, and thus the vacuum cleaner 1 may be easily moved forward and backward, and friction between a floor surface and the vacuum cleaner 1 may be reduced.

The rib 69 may be formed to protrude from the inlet port 63, and inserted into the opening 4 of the stick body 14, when the vacuum cleaner 1 is installed at an installation space 3, such that the air does not leak between the inlet port 63 and the opening 4. Also, when the vacuum cleaner 1 is tilted and the inlet port 63 is in contact with the floor surface, the rib 69 reduces a distance between the floor surface and the inlet port 63, and a suction force of the suction unit 200 is sufficiently transmitted to the floor surface, and thus dust sucking performance from the surface to be cleaned may be enhanced.

The dust collector 100 may include a dust container 102, a cover member 104, the filter unit 70 and a cyclone container 107. The dust container 102 may be formed of a transparent material, and the filter unit 70 may be removably installed at one side thereof.

The cover member 104 may be formed of a transparent material, and may be integrally formed with the dust container 102. When the cover member 104 is installed at the cyclone installation space (not shown) of the vacuum cleaner 1, the cover member 104 may form an exterior of the vacuum cleaner 1.

The cyclone container 107 may be installed at an inner side of the dust container 102 so as to partition an internal space of the dust container 102 into a centrifugal chamber S1 and a dust receiving chamber S2. A central pipe 108 may be provided at a center of the cyclone container 107, and a spiral path guide member 106 which induces rotation of the air introduced through the cyclone entrance 110 may be installed between the cyclone container 107 and the central pipe 108.

The vacuum cleaner 1 may be removably coupled to the stick body 14.

The stick body 14 may be divided into a handle part 16 formed at an upper portion thereof, and a pot-shaped central part 11 formed at a lower portion thereof having the installation space 3. The handle part 16 coupled to an upper end of the central part 11 is a part which is gripped by a user to push or pull a nozzle assembly 2. The installation space 3 formed at the central part 11 is a space in which the vacuum cleaner 1 is able to be installed at or separated from the stick body 14.

In FIG. 1, a front surface of the stick body 14 is a surface when seen in an A direction, and a rear surface thereof is a surface when seen in a B direction. A main body air exhaust part 20 having a plurality of air exhaust holes may be formed at the front surface of the stick body 14, and a main body transparent part 18 formed of a transparent panel may be formed under the main body air exhaust part 20.

The nozzle assembly 2 may be rotatably connected to a lower end of the stick body 14, and may be in communication with an internal air path (not shown) neck part 6 of the nozzle assembly 2 and the opening 4 of the stick body 14. Therefore, external air and dust introduced through the nozzle assembly 2 may be introduced into the vacuum cleaner 1 through the opening 4 of the stick body 14 and the neck part 6. A bottom inlet port 2*a* which sucks the air of the surface to be cleaned may be formed at a bottom surface of the nozzle assembly 2, and a cylindrical brush (not shown)

which rakes out the dust on the surface to be cleaned may be rotatably installed at an inner side of the nozzle assembly 2.

The first connection terminal 12 may be provided at the installation space 3 of the stick body 14, and a second connection terminal 60 may be installed at the rear surface of the vacuum cleaner 1. When the vacuum cleaner 1 is installed at the installation space 3, the first connection terminal 12 may be in contact with the second connection terminal 60, and thus the stick body 14 may be electrically connected with the vacuum cleaner 1.

The suction unit 200 will be described later in detail.

Hereinafter, an operation process of the vacuum cleaner 1 will be described.

A power supply to the suction unit 200 installed in the main body 52 may be switched on and off using the power button 65 installed at the main body 52. The inlet port 63 and the roller 114 of the vacuum cleaner 1 may be in contact with the surface to be cleaned, and the external air and the dust may be sucked while the vacuum cleaner 1 is moved. When the vacuum cleaner 1 is operated, the external air may be introduced into the dust collector 100 through the inlet port 63 and the cyclone entrance 110. Since the cyclone entrance 110 is located at a lower side, the air passing through the inlet port 63 may be directly introduced into the cyclone entrance 110 in contact with the inlet port 63. The external air including the introduced dust may be rotated along the spiral path guide member 106, and introduced into the centrifugal chamber S1, and thus the dust included in the air may be separated from the air by a centrifugal force and then stored in the dust container 102 through an upper end of the cyclone container 107. The air from which the dust is separated may be continuously moved straight toward an upper side without a change in a moving direction and passes through the filter unit 70 installed above the cyclone container 107. At this time, fine dust remained in the air may be removed by a grille part 71 and a filter member (not shown), and then discharged to the first and second air exhaust parts 56 and 58 of the vacuum cleaner 1 through the suction unit 200.

When the vacuum cleaner 1 is used while installed at the stick body 14 (hereinafter, called "stick type cleaner"), the user may push a power switch (not shown) installed at the stick body 14, may operate the stick type cleaner, may grip the handle part 16 of the stick body 14 with his or her hand, may tilt the stick body 14 with respect to the nozzle assembly 2, and then may use the stick type cleaner 1. The user may properly tilt the stick body 14 according to his or her physical condition (e.g., height, or other physical characteristics), and then may perform a cleaning operation while moving the stick type cleaner forward, backward, left and right. The external air including the dust may be introduced into the dust collector 100 through the nozzle assembly 2, the neck part 6 and the opening 4 of the stick body 14. The external air introduced into the dust collector 100 may be rotated in the centrifugal chamber S1, and the dust included in the external air is separated by the centrifugal force, and then stored in the dust container 102. The air from which the dust is separated may pass through the filter unit 70 so that the fine dust is removed by the grille part 71 and the filter member (not shown), and then may be discharged to the first and second air exhaust parts 56 and 58 of the vacuum cleaner 1 through the suction unit 200. The air discharged to the second air exhaust part 58 may be discharged to the front surface of the stick body 14 through the main body air exhaust part 20.

Figure 4:
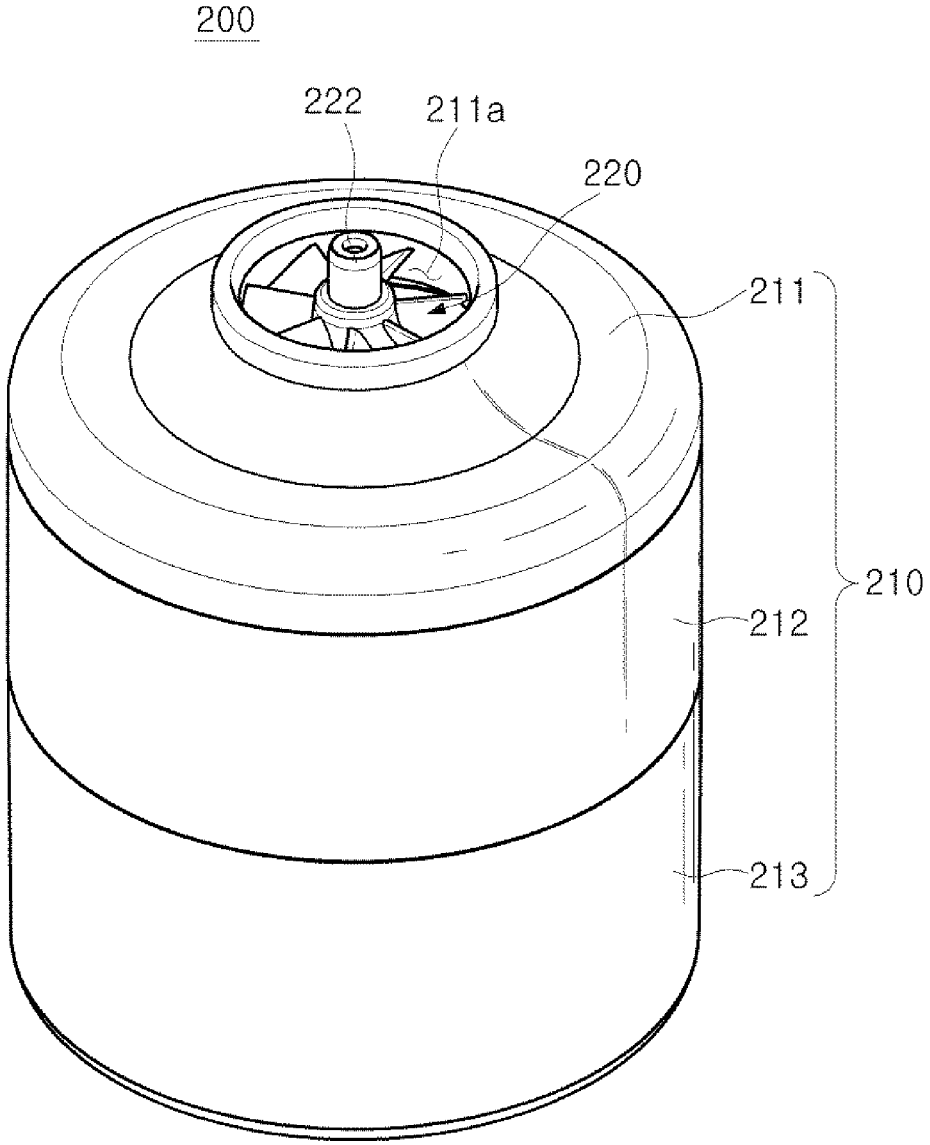
FIG. 4 is a perspective view illustrating a suction unit of the vacuum cleaner in accordance with an embodiment of the disclosure.
Figure 5:
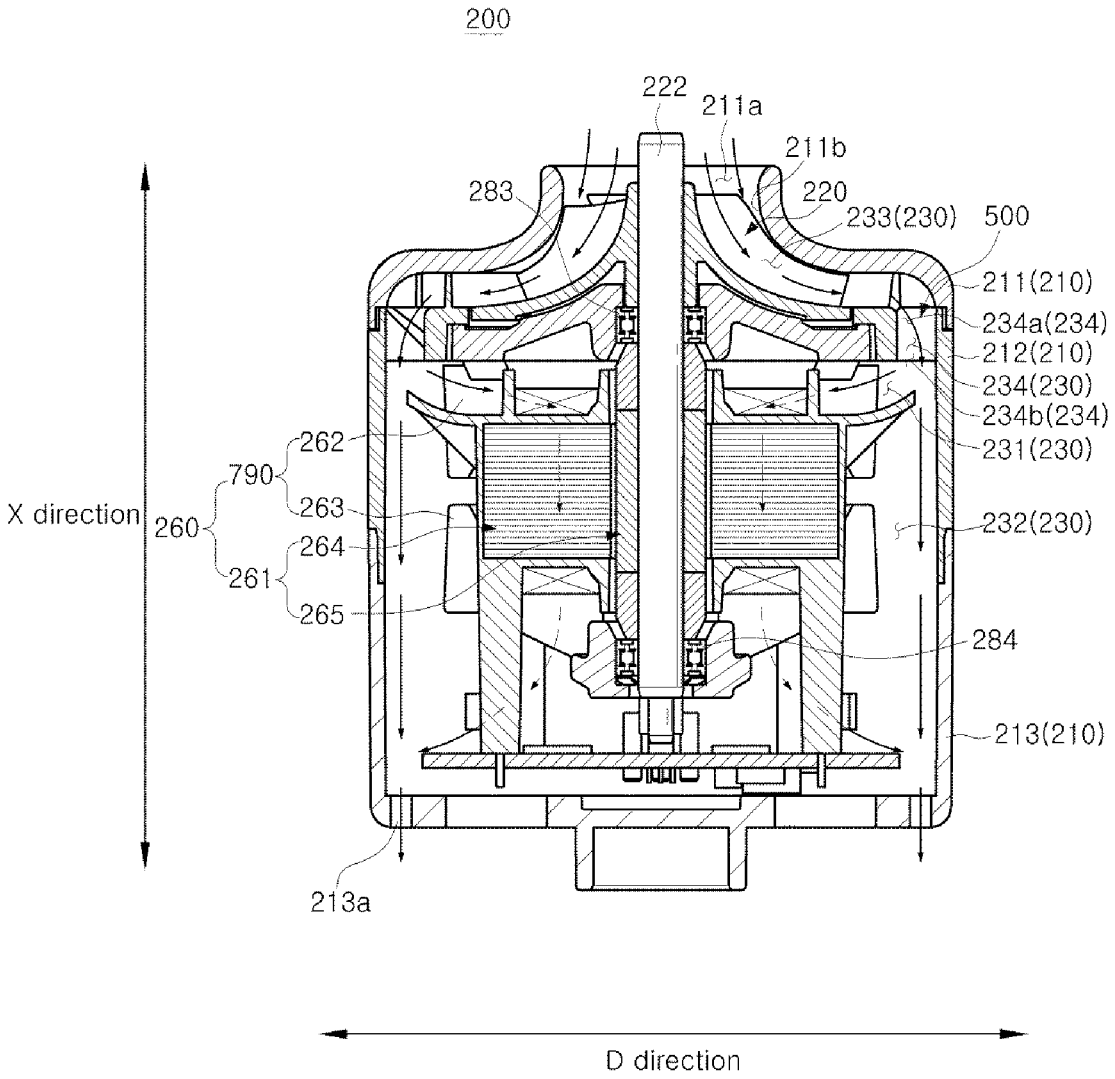
FIG. 5 is a cross-sectional view illustrating the suction unit of the vacuum cleaner in accordance with an embodiment of the disclosure.
Figure 6:
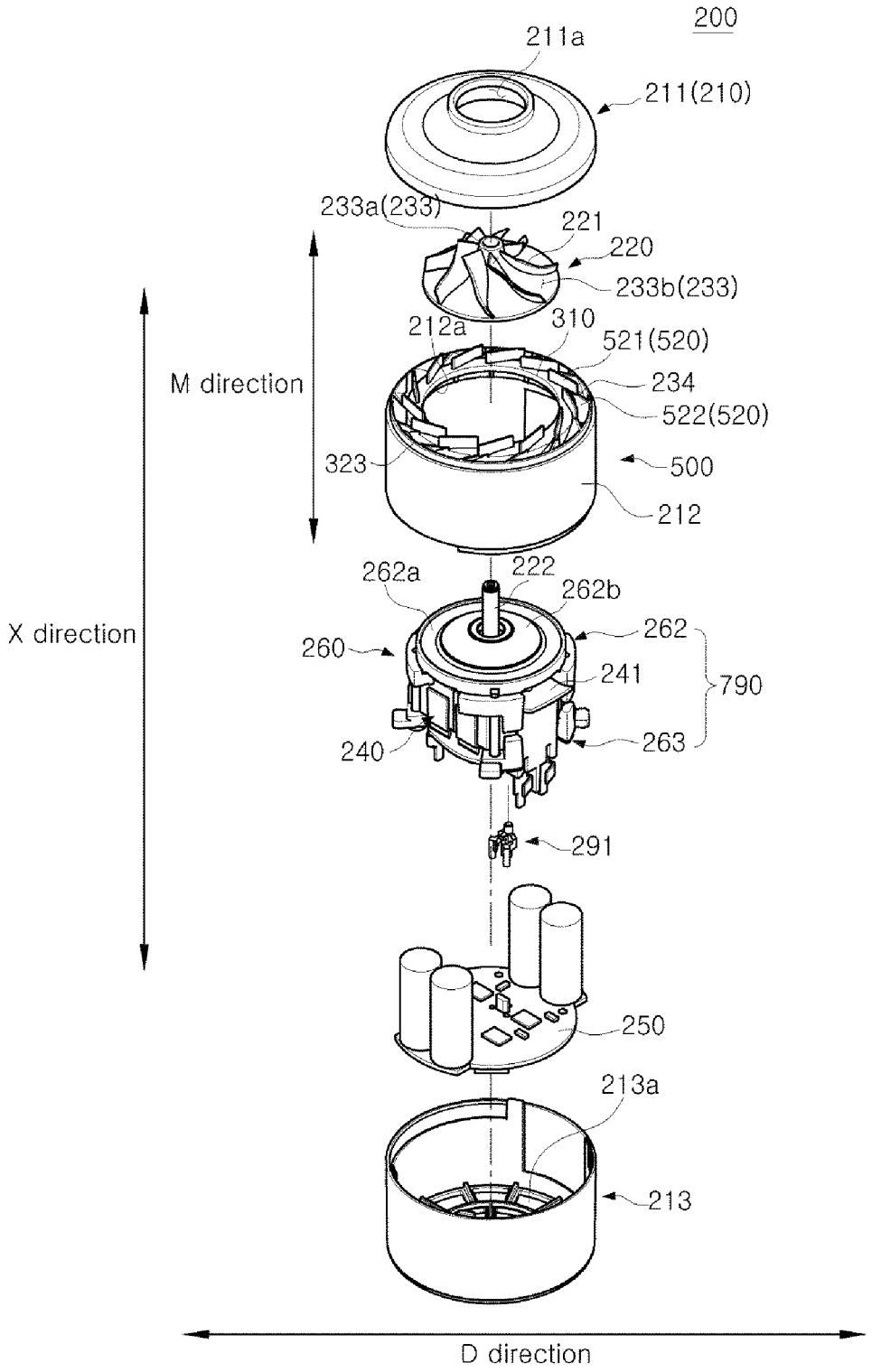
FIG. 6 is an exploded perspective view illustrating the suction unit of the vacuum cleaner in accordance with an embodiment of the disclosure.
Figure 7A:
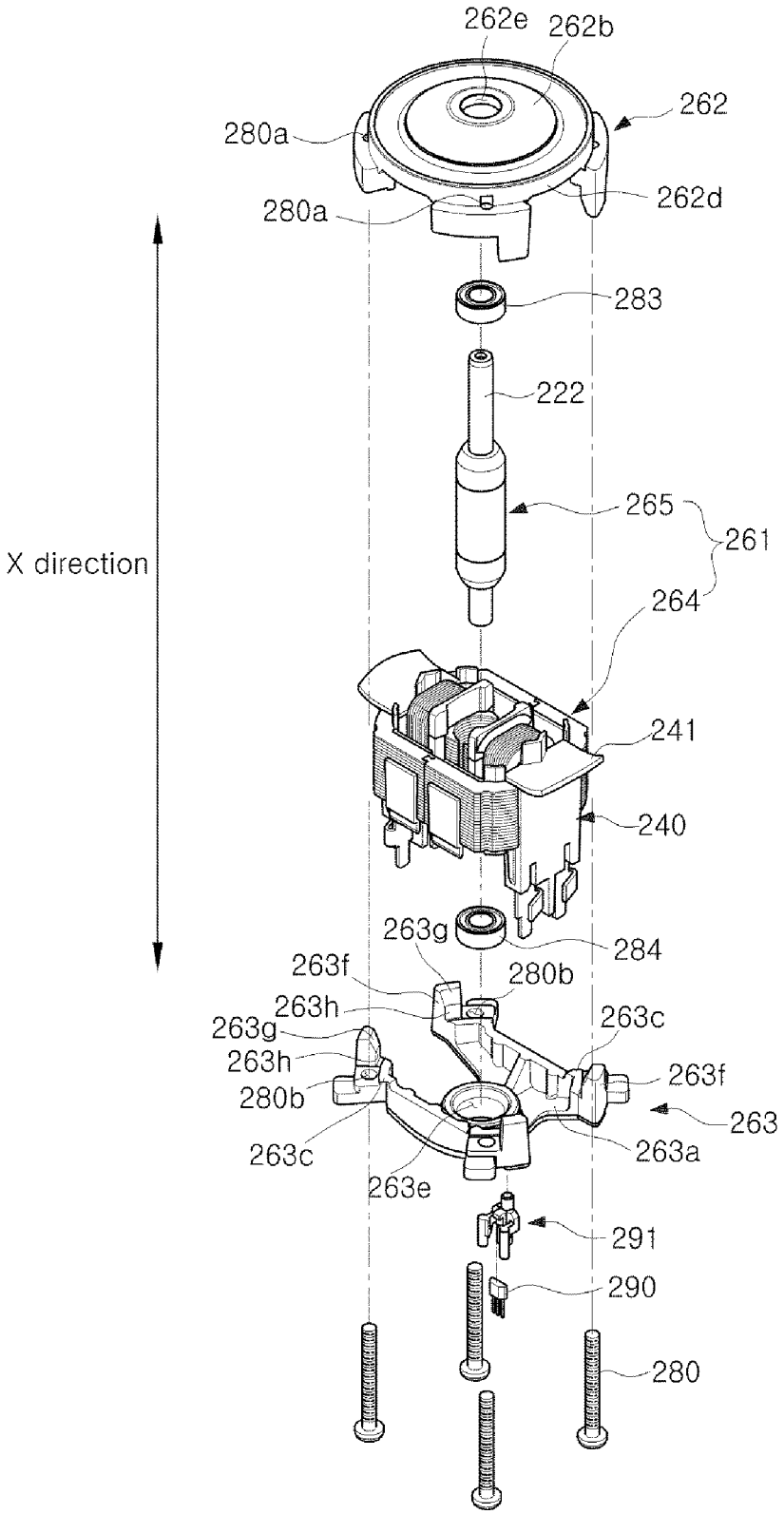
FIGS. 7A and 7B are exploded perspective views illustrating a motor module in the suction unit of the vacuum cleaner in accordance with an embodiment of the disclosure.
Figure 7B:
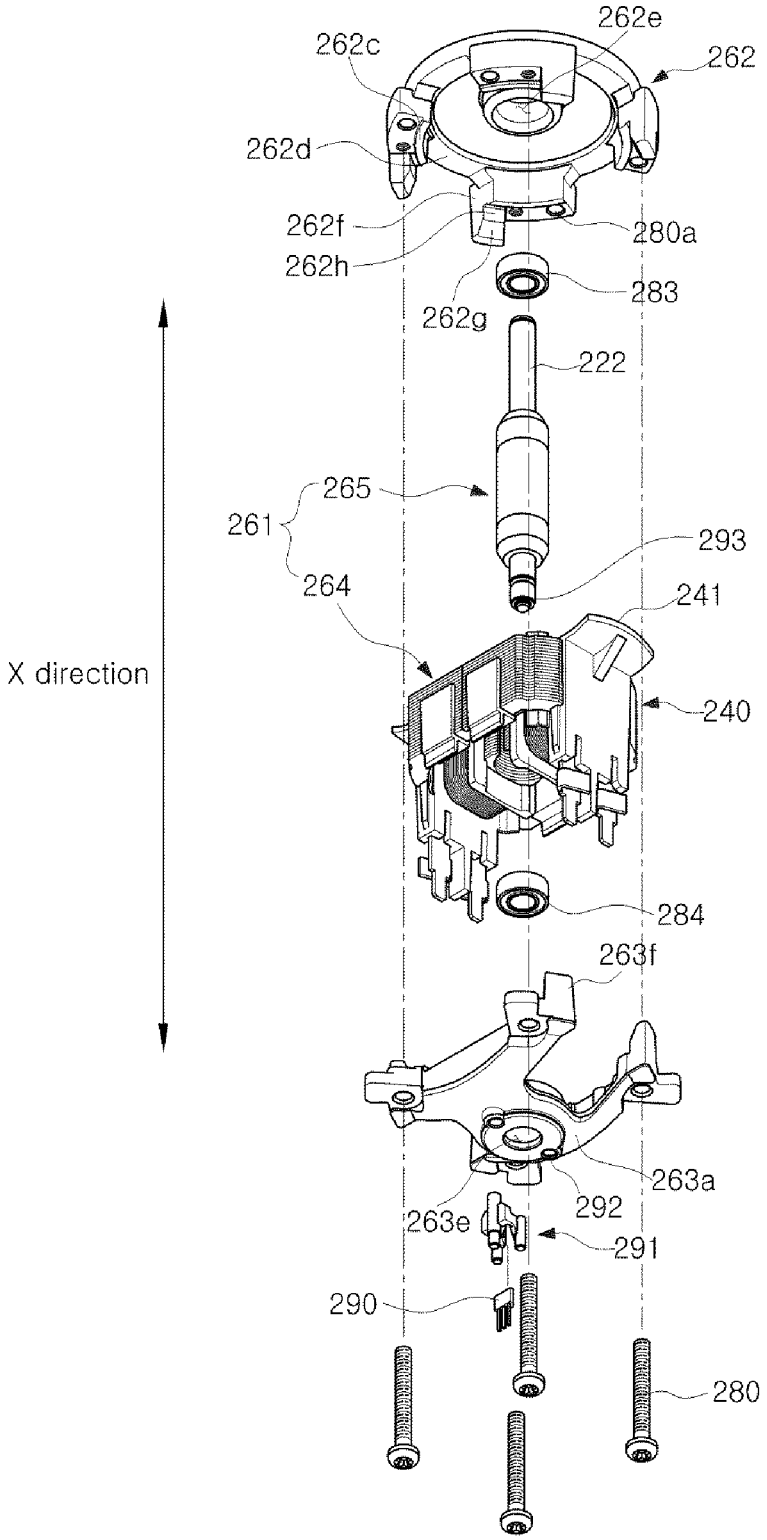

FIG. 4 is a perspective view illustrating the suction unit of the vacuum cleaner in accordance with an embodiment of the disclosure, FIG. 5 is a cross-sectional view illustrating the suction unit of the vacuum cleaner in accordance with an embodiment of the disclosure, FIG. 6 is an exploded perspective view illustrating the suction unit of the vacuum cleaner in accordance with an embodiment of the disclosure, and FIGS. 7A and 7B are exploded perspective views illustrating a motor module in the suction unit of the vacuum cleaner in accordance with an embodiment of the disclosure. Hereinafter, reference numerals which are not described may correspond to those previously discussed with reference to FIGS. 1 to 3.

The suction unit 200 may be provided at an inner side of the main body 52 to generate the suction force.

The suction unit 200 may include a housing 210 which forms an exterior thereof.

The housing 210 may have a cylindrical shape, but is not limited thereto.

The housing 210 may include a plurality of housings which are detachably coupled with each other. The housing 210 according to the disclosure may include a first housing 211, a second housing 212 and a third housing 213. The first housing 211, the second housing 212 and the third housing 213 may be arranged, in turn, in an axial direction X of an impeller 220. The first housing 211 may be arranged at an upper portion in the axial direction X of the impeller 220, and the third housing 213 may be arranged at a lower portion in the axial direction X of the impeller 220. The second housing 212 may be arranged between the first housing 211 and the third housing 213.

Also the first housing 211, the second housing 212 and the third housing 213 may be detachably coupled with each other in the axial direction X of the impeller 220. Specifically, the first housing 211 may be detachably coupled with the second housing 212. The second housing 212 may be detachably coupled with the first housing 211 and/or the third housing 213. The third housing 213 may be detachably coupled with the second housing 212.

An air inlet port 211*a* may be provided at the first housing 211 so that the air is introduced into the suction unit 200. An air outlet port 213*a* may be provided at the third housing 213 so that the air introduced into the suction unit 200 through the air inlet port 211*a* is discharged to an outside of the suction unit 200. In another aspect, the air inlet port 211*a* may be provided at an upper portion of the housing 210 in the axial direction X of the impeller 220, and the air outlet port 213*a* may be provided at a lower portion of the housing 210 in the axial direction X of the impeller 220. However, positions of the air inlet port 211*a* and the air outlet port 213*a* are not limited thereto, and may be variously changed.

An air path 230 which connects the air inlet port 211*a* with the air outlet port 213*a* may be formed at an inner side of the housing 210.

The air path 230 may include a module path 231, a module external path 232, an air flowing path 233 and a diffuser path 234. In other words, the module path 231, the module external path 232, the air flowing path 233 and the diffuser path 234 may be commonly called the air path 230.

The air introduced into the suction unit 200 through the air inlet port 211*a* flows along the air path 230. Specifically, the air introduced into the suction unit 200 through the air inlet port 211*a* may pass through the air flowing path 233 provided at the impeller 220 and then may be transmitted to the diffuser path 234. The module path 231 and the module external path 232 may be branched from the diffuser path 234. That is, a part of the air passing through the diffuser path 234 may flow along the module path 231, and another part of the air passing through the diffuser path 234 may flow along the module external path 232.

First, the module path 231 and the module external path 232 will be described.

The air introduced into the suction unit 200 through the air inlet port 211*a* flows along the air path 230. Specifically, the air introduced into the housing 210 flows along the module path 231 which is guided to an inner side of the motor module 260 by a path guide part 241 of an insulator 240. Further, the air introduced into the housing 210 flows along the module external path 232 formed between the motor module 260 and the housing 210. That is, a part of the air introduced into the housing 210 flows along the module path 231, and another part of the air introduced into the housing 210 flows along the module external path 232. The air flowing along the module path 231 may cool heat generated from the motor module 260. Also, the air flowing along the module path 231 and the module external path 232 may cool heat generated from a circuit board 250 while passing through the circuit board 250.

The first housing 211 may include a shroud 211*b*.

The shroud 211*b* may be provided to correspond to the impeller 220 or the diffusers 300, 400, 500, 600 and 700 (described later) and thus to guide the air introduced into the housing 210. Specifically, the shroud 211*b* serves to guide the air introduced through the air inlet port 211*a* into the housing 210. Further, the shroud 211*b* may have a shape corresponding to an upper portion of the impeller 220. In other words, the shroud 211*b* may be coupled with a plurality of wings 221 of the impeller 220 to form the air flowing path 233.

The suction unit 200 may further include the impeller 220.

The impeller 220 may be arranged to be rotated about a shaft 222 and to suck the air. Also, the impeller 220 may be provided to be rotated with the shaft 222. The impeller 220 may be provided at an inner side of the first housing 211. The impeller 220 may be connected with a motor 261 to be rotated and may serve to suck the air into the suction unit 200. The impeller 220 may be formed to suck the air in the axial direction X of the impeller 220 and to radially discharge the air. The impeller 220 may have the plurality of wings 221 which generates a flow of the air. The plurality of wings 221 may be radially formed about the shaft 222. The air flowing path 233 may be provided between the plurality of wings 221 arranged to be spaced from each other. The air flowing path 233 may include an inflow port 233*a* which is located at an upper stream side in a flowing direction M of the air introduced through the air inlet port 211*a*, and an outflow port 233*b* which is located at a lower stream side in the flowing direction M of the air introduced through the air inlet port 211*a*. A shape and an arrangement of the impeller 220 may be variously changed, and it is sufficient as long as the air may flow.

The suction unit 200 may further include the diffusers 300, 400, 500, 600 and 700.

The diffusers 300, 400, 500, 600 and 700 serve to convert kinetic energy of the air sucked into the suction unit 200 by the impeller 220 into pressure energy. In another aspect, the diffusers 300, 400, 500, 600 and 700 serve to reduce a flow speed of the air flow by the impeller 220. The diffusers 300, 400, 500, 600 and 700 may be arranged to guide the air discharged from the impeller 220. The diffusers 300, 400, 500, 600 and 700 may be arranged along an outer circumference of the impeller 220 to face the outflow port 233*b* of the air flowing path 233.

The diffusers 300, 400, 500, 600 and 700 will be described later in detail.

The suction unit 200 may further include the motor module 260.

The motor module 260 may be provided at an inner side of the housing 210. The motor module 260 may be provided so that the motor 261 as one module is fixed to the inner side of the housing 210.

The motor module 260 may include the motor 261 and a seating housing 790.

The motor 261 may be installed at the inner side of the housing 210 to generate the suction force or a rotating force. The seating housing 790 may be provided so that the motor 261 is fixed to the inner side of the housing 210.

The seating housing 790 may include a first seating housing 262 and a second seating housing 263 which is coupled with the first seating housing 262 while the motor 261 is interposed therebetween.

The first seating housing 262 may be provided to be fixed to the housing 210.

Specifically, a seating hole 212*a* may be formed at an inner side of the second housing 212 so that the first seating housing 262 is coupled therein. The seating hole 212*a* may have a hole shape. The first seating housing 262 may be fitted into the seating hole 212*a*, but a coupling method thereof is not limited thereto.

The first seating housing 262 may include a first seating housing body 262*a*, an impeller seating part 262*b* and a first seating part 262*c*. The first seating housing body 262*a* may have a circular plate shape. The first seating housing body 262*a* may include a body coupling part 262*d* which corresponds to a shape of the seating hole 212*a* so as to be coupled to the seating hole 212*a* of the second housing 212.

The impeller seating part 262*b* may be provided on an upper surface of the first seating housing body 262*a* so that the impeller 220 is seated thereto. An upper surface of the first seating housing body 262*a* may be formed to correspond to a shape of a rear surface of the impeller 220 and thus not to be interfered with rotation of the impeller 220 coupled to the shaft 222.

The first seating part 262*c* may be provided at a lower surface of the first seating housing body 262*a* so that the motor 261 is seated thereto. The first seating part 262*c* may allow a stator 264 to be seated and fixed, such that a center of the shaft 222 is arranged to coincide with a rotating center of the impeller 220.

In an embodiment of the disclosure, the first seating part 262*c* may be formed to protrude from the first seating housing body 262*a*, such that the first seating housing body 262*a* and the motor 261 are coupled so as to be spaced apart a predetermined distance from one another. However, a shape of the first seating part 262*c* is not limited thereto.

Four first seating parts 262*c* may be provided to correspond to each end of the stator 264. However, the arrangement structure of the first seating part 262*c* is not limited thereto.

The second seating housing 263 may be provided to be coupled with the first seating housing 262. Also, the second seating housing 263 may be provided so that the motor 261 is located between the first seating housing 262 and the second seating housing 263.

The second seating housing 263 may include a second seating housing body 263*a* and a second seating part 263*c*. The second seating housing body 263*a* may be formed to be elongated in a lengthwise direction of the stator 264 and to correspond to a shape of the stator 264.

Four second seating parts 263*c* may be provided to correspond to each end of the stator 264. However, an arrangement structure of the second seating part 263*c* is not limited thereto.

The first seating housing 262 and the second seating housing 263 may be coupled with each other by a fixing member 280. The fixing member 280 may include a screw, however the disclosure is not so limited, and may include other types of fixing members (e.g., a bolt, a pin, a rivet, an anchor, a clip, and the like). Therefore, fixing holes 280*a* and 280*b* through which the fixing member 280 is coupled may be provided at the first seating housing 262 and the second seating housing 263, respectively.

A first through-hole 262*e* and a second through-hole 263*e* through which the shaft 222 passes may be provided at centers of the first seating housing 262 and the second seating housing 263, respectively. A first bearing 283 and a second bearing 284 may be respectively arranged at the first through-hole 262*e* and the second through-hole 263*e* to support rotation of the shaft 222.

The first seating housing 262 may include a first seating protrusion 262*f* and the first seating part 262*c*.

The first seating part 262*c* may be provided at an inner side of the first seating housing 262. Also, the first seating part 262*c* may be provided so that one side surface of the motor 261 is seated thereto. The first through-hole 262*e* may be formed at centers of a plurality of first seating parts 262*c* so that centers of a rotor 265, the impeller 220 and the diffusers 300, 400, 500, 600 and 700 coincide with each other, while the stator 264 is seated or fixed to the first seating part 262*c*.

The first seating protrusion 262*f* may be formed to protrude from the first seating housing body 262*a* along a circumference of the first seating part 262*c*. Also, the first seating protrusion 262*f* may be provided so that the motor 261 is covered by an inner surface of the first seating protrusion 262*f*. When the suction unit 200 is operated, the first seating protrusion 262*f* prevents a position of the motor 261 from being twisted in a direction vertical to the shaft 222. Specifically, an upper surface of the motor 261 is seated to the first seating part 262*c*, and the side surface of the motor 261 is seated to a first protrusion seating surface 262*h* of the first seating protrusion 262*f*. A first guide surface 262*g* may be formed at the first seating protrusion 262*f* to guide the motor 261 and thus to allow the motor 261 to be easily seated to the first seating part 262*c*. The first guide surface 262*g* may be provided at an end of the first seating protrusion 262*f* and may be formed to be inclined inward at a predetermined angle. Further, the first guide surface 262*g* may be provided to be connected with the first protrusion seating surface 262*h*.

The first seating housing body 262*a* may be formed in a circular shape. For example, four first seating protrusions 262*f* may be arranged to protrude from the first seating housing body 262*a*. However, the disclosure is not so limited and the first seating housing body 262*a* may include more than or less than four first seating protrusions 262*f*.

The second seating housing 263 may include a second seating protrusion 263*f* and the second seating part 263*c*.

The second seating part 263*c* may be provided at an inner side of the second seating housing 263 so that another side surface of the motor 261 is seated thereto. The second through-hole 263*e* may be formed at centers of a plurality of second seating parts 263*c* so that centers of a rotor 265, the impeller 220 and the diffusers 300, 400, 500, 600 and 700 coincide with each other, while the stator 264 is seated or fixed to the first seating part 262*c*.

The second seating protrusion 263*f* may be formed to protrude from the second seating housing body 263*a* along a circumference of the second seating part 263*c*. Also, the second seating protrusion 263*f* may be provided so that the motor 261 is covered by an inner surface of the second seating protrusion 263*f*. When the suction unit 200 is operated, the first seating protrusion 262*f* and the second seating protrusion 263*f* prevents the position of the motor 261 from being twisted in the direction vertical to the shaft 222.

A second guide surface 263*g* formed to be inclined at a predetermined angle may be formed at an inner side of the second seating protrusion 263*f* to allow the motor 261 to be easily seated to the second seating part 263*c*, when the motor 261 is coupled with the second seating protrusion 263*f*. Specifically, a lower surface of the motor 261 may be seated to the second seating part 263*c*. The side surface of the motor 261 may be seated to a second protrusion seating surface 263*h* of the second seating protrusion 263*f*. The second guide surface 263*g* may be formed at the second seating protrusion 263*f* to guide the motor 261 and thus to allow the motor 261 to be easily seated to the second seating part 263*c*. The second guide surface 263*g* may be provided at an end of the second seating protrusion 263*f* and may be formed to be inclined at the predetermined angle. Further, the second guide surface 263*g* may be provided to be connected with the second protrusion seating surface 263*h*.

The second seating housing body 263*a* may be formed to be elongated in the lengthwise direction of the stator 264 and to correspond to the shape of the stator 264. For example, four second seating protrusions 263*f* may be provided at positions corresponding to the first seating protrusions 262*f* of the first seating housing 262. However, the disclosure is not so limited and the second seating housing body 263*a* may include more than or less than four second seating protrusions 263*f*.

A sensor magnet 293 may be coupled to a lower portion of the shaft 222.

The sensor magnet 293 may be magnetized at the same time with a magnet (not shown) provided at the rotor 265 and may have the same magnetization direction as the magnet of the rotor 265. The sensor magnet 293 may be provided on the same axis as the magnet of the rotor 265, and a hole sensor 290 may sense a magnetic field of the sensor magnet 293 and may grasp a position of the rotor 265 according to the rotation. Therefore, the position of the rotor 265 may be controlled. The hole sensor 290 may be arranged to be seated to a sensor bracket 291. One end of the sensor bracket 291 may be coupled to a sensor seating part 292 provided at a rear surface of the second seating housing 263. The other end of the sensor bracket 291 may be coupled to the circuit board 250.

The first seating housing 262 and the second seating housing 263 may be coupled by the fixing member 280. Therefore, the fixing holes 280*a* and 280*b* through which the fixing member 280 is coupled may be provided at the first seating housing 262 and the second seating housing 263, respectively.

Figure 8:
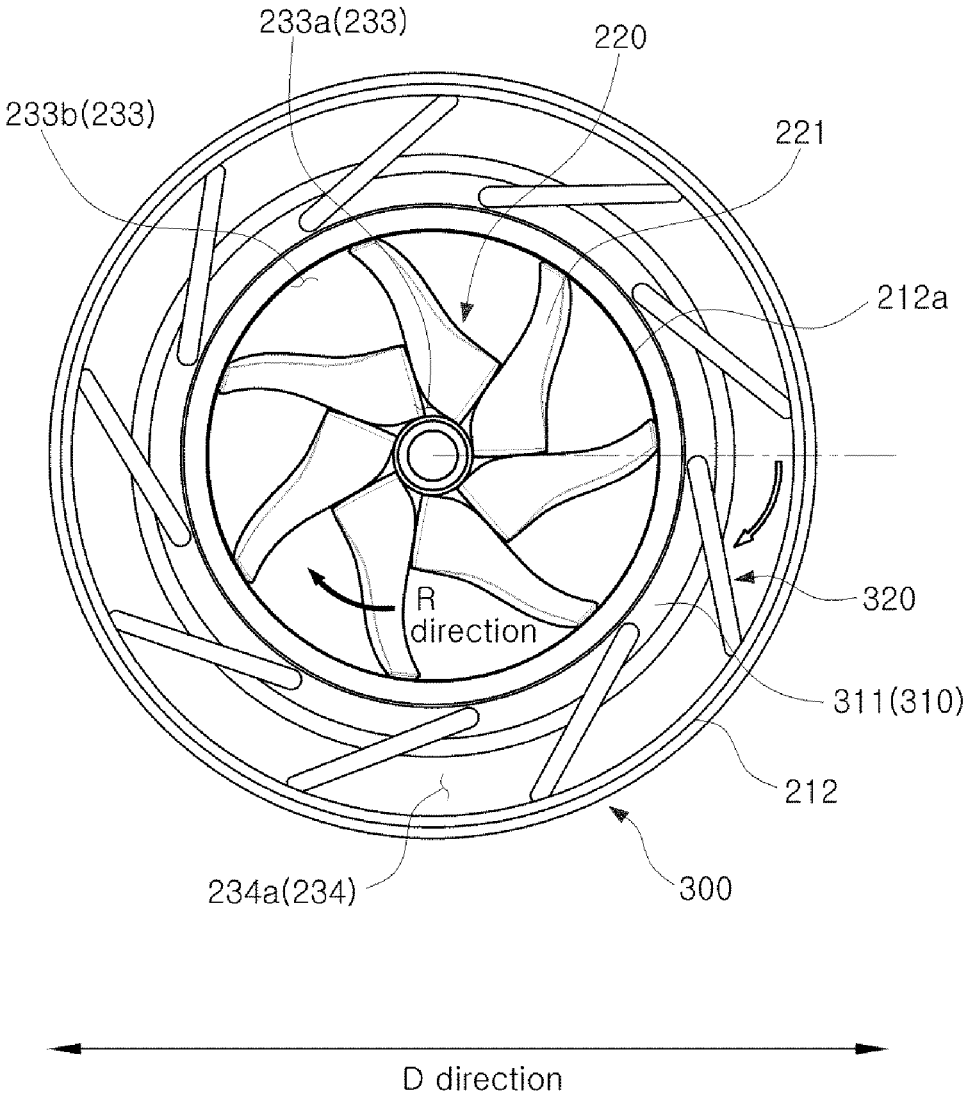
FIG. 8 is a view for explaining a first embodiment of an arrangement structure of a plurality of blades in the suction unit of the vacuum cleaner in accordance with an embodiment of the disclosure.

FIG. 8 is a view for explaining an embodiment of an arrangement structure of the plurality of blades in the suction unit of the vacuum cleaner in accordance with an embodiment of the disclosure. Hereinafter, reference numerals which are not described may correspond to those previously discussed with reference to FIGS. 1 to 7B. Hereinafter, a path may have the same meaning as or correspond to the diffuser path 234. Also, the second housing 212 may have the same meaning as or correspond to each outer casing 212 of the diffusers 300, 400, 500, 600 and 700.

The diffusers 300, 400, 500, 600 and 700 may include casings 212 and 310.

The casings 212 and 310 may include an inner casing 310 and an outer casing 212.

The outer casing 212 may be located at an outer side in a radial direction D of the inner casing 310.

The outer casing 212 may be arranged along an outer circumference of the inner casing 310.

The outer casing 212 may be arranged to be spaced apart from the inner casing 310.

The outer casing 212 may be arranged along the outer circumference of the inner casing 310 to be spaced therefrom.

The inner casing 310 and the outer casing 212 may be integrally formed.

The inner casing 310 may include the seating hole 212*a* and a frame 311. The seating hole 212*a* may be formed at a center portion of the inner casing so that the first seating housing 262 is coupled thereto. The seating hole 212*a* may have the hole shape, but the shape of the seating hole 212*a* is not limited thereto. The impeller 220 may be seated to the impeller seating part 262*b* of the first seating housing 262 in the seating hole 212*a*. The frame 311 may be provided at an outside of the seating hole 212*a*. The frame 311 may be arranged along a circumference of the seating hole 212*a*. In other words, the frame 311 may define a boundary of the seating hole 212*a*. The frame 311 may be formed to have a predetermined width in the radial direction D of the inner casing 310.

The diffusers 300, 400, 500, 600 and 700 may further include the diffuser path 234.

The diffuser path 234 may be formed at an inner side of the casings 212 and 310. Specifically, the diffuser path 234 may be provided between the inner casing 310 and the outer casing 212 so that the air passing through the air flowing path 233 flows therethrough. The diffuser path 234 may be arranged adjacent to the air flowing path 233. In other words, the diffuser path 234 may be arranged adjacent to the outflow port 233*b* of the air flowing path 233. Alternatively, the diffuser path 234 may be connected with the air flowing path 233. The diffuser path 234 may be directly or indirectly connected with the air flowing path 233.

The diffuser path 234 may include an entrance 234*a* which is located at an upper stream side in a flowing direction M of the air discharged from the impeller 220 and an exit 234*b* which is located at a lower stream side in the flowing direction M of the air discharged from the impeller 220. That is, the entrance 234*a* may be located at an upper stream side in a flowing direction M of the air passing through the air flowing path 233, and the exit 234*b* may be located at a lower stream side in the flowing direction M of the air passing through the air flowing path 233.

The diffusers 300, 400, 500, 600 and 700 may further include a plurality of blades 320, 420, 520, 620 and 720.

The plurality of blades 320, 420, 520, 620 and 720 may be arranged between the inner casing 310 and the outer casing 212 to guide the air discharged from the impeller 220.

The plurality of blades 320, 420, 520, 620 and 720 may connect the inner casing 310 with the outer casing 212.

The plurality of blades 320, 420, 520, 620 and 720 may be integrally formed with at least one of the inner casing 310 and the outer casing 212.

The plurality of blades 320, 420, 520, 620 and 720 may be integrally formed with at least one of the inner casing 310 and the outer casing 212 to connect the inner casing 310 with the outer casing 212.

The plurality of blades 320, 420, 520, 620 and 720 may be radially arranged toward an outside in the radial direction D of the inner casing 310.

The plurality of blades 320, 420, 520, 620 and 720 may be installed at the inner casing 310 to extend toward the outer casing 212. That is, the plurality of blades 320, 420, 520, 620 and 720 may be installed at the inner casing 310 to extend toward the outer casing 212 outward in the radial direction D of the inner casing 310.

Alternatively, the plurality of blades 320, 420, 520, 620 and 720 may be installed at the outer casing 212 to extend toward the inner casing 310. That is, the plurality of blades 320, 420, 520, 620 and 720 may be installed at the outer casing 212 to extend toward the inner casing 310 inward in the radial direction D of the inner casing 310.

The plurality of blades 320, 420, 520, 620 and 720 may further include a plurality of vanes 421, 521, 621 and 721 and a plurality of guides 422, 522 and 622.

The plurality of vanes 421, 521, 621 and 721 and the plurality of guides 422, 522 and 622 may be formed integrally.

Alternatively, the plurality of vanes 421, 521, 621 and 721 and the plurality of guides 422, 522 and 622 may be assembled with or coupled to each other.

Alternatively, the plurality of vanes 421, 521, 621 and 721 and the plurality of guides 422, 522 and 622 may be spaced apart from each other.

The plurality of vanes 421, 521, 621 and 721 and the plurality of guides 422, 522 and 622 may be arranged to face each other in the axial direction X of the impeller 220. Specifically, the plurality of vanes 421, 521, 621 and 721 may be located above the plurality of guides 422, 522 and 622 in the axial direction X of the impeller 220, and the plurality of guides 422, 522 and 622 may be located under the plurality of vanes 421, 521, 621 and 721 in the axial direction X of the impeller 220.

The plurality of vanes 421, 521, 621 and 721 may be disposed at at least one of the inner casing 310 and the outer casing 212.

The plurality of vanes 421, 521, 621 and 721 may be disposed at the inner casing 310. The plurality of vanes 421, 521, 621 and 721 may be provided on the inner casing 310 to face the outflow port 233*b* of the air flowing path 233. Also, the plurality of vanes 421, 521, 621 and 721 may be provided on the inner casing 310 to extend outward in the radial direction D of the inner casing 310. Specifically, the plurality of vanes 421, 521, 621 and 721 may be provided on the frame 311 of the inner casing 310 to extend outward in the radial direction D of the inner casing 310.

The plurality of vanes 421, 521, 621 and 721 may be disposed at the outer casing 212. The plurality of vanes 421, 521, 621 and 721 may be disposed on the outer casing 212 to extend inward in the radial direction D of the inner casing 310. The plurality of vanes 421, 521, 621 and 721 may extend toward the inner casing 310 to face the outflow port 233*b* of the air flowing path 233.

The plurality of vanes 421, 521, 621 and 721 may be disposed at the inner casing 310 and the outer casing 212. The plurality of vanes 421, 521, 621 and 721 may be disposed on the inner casing 310 and the outer casing 212 to connect the inner casing 310 with the outer casing 212. Alternatively, the plurality of vanes 421, 521, 621 and 721 may be discontinuously disposed at the inner casing 310 and the outer casing 212.

Like this, the plurality of vanes 421, 521, 621 and 721 may be disposed at at least one of the inner casing 310 and the outer casing 212 to extend outward in the radial direction D of the inner casing 310, and thus the air path 230 through which the air introduced through the air inlet port 211*a* flows, particularly, the air flowing path 233 or the diffuser path 234 may secure a sufficient length. Therefore, an improvement effect of suction performance of the suction unit 200 may be expected.

The plurality of vanes 421, 521, 621 and 721 may be disposed on the inner casing 310 to protrude toward the outer casing 212. The plurality of vanes 421, 521, 621 and 721 may be disposed on the frame 311 to protrude toward the outer casing 212. However, the arrangement structure of the plurality of vanes 421, 521, 621 and 721 is not limited thereto, and the plurality of vanes 421, 521, 621 and 721 may be disposed on the outer casing 212 to protrude toward the inner casing 310.

The plurality of vanes 421, 521, 621 and 721 may be provided to cross at least a part of the diffuser path 234. The plurality of vanes 421, 521, 621 and 721 may be provided to cross at least a part of the diffuser path 234 in the radial direction D of the inner casing 310. The plurality of vanes 421, 521, 621 and 721 may be provided to cross at least a part of the entrance 234*a*.

The plurality of vanes 421, 521, 621 and 721 may be disposed at at least one of the inner casing 310 and the outer casing 212 to be inclined with respect to the radial direction D of the inner casing 310. Specifically, the plurality of vanes 421, 521, 621 and 721 may be disposed at at least one of the inner casing 310 and the outer casing 212 to be inclined along a rotating direction R of the impeller 220 with respect to the radial direction D of the inner casing 310. In other words, the plurality of vanes 421, 521, 621 and 721 may be disposed at at least one of the inner casing 310 and the outer casing 212 to be gradually inclined from the inner casing 310 toward the outer casing 212.

The plurality of vanes 421, 521, 621 and 721 may connect the air flowing path 233 and the diffuser path 234.

The plurality of guides 422, 522 and 622 may be disposed on the diffuser path 234.

The plurality of guides 422, 522 and 622 may be disposed to be coupled with at least one of the inner casing 310 and the outer casing 212.

The plurality of guides 422, 522 and 622 may connect the inner casing 310 and the outer casing 212. The plurality of guides 422, 522 and 622 may directly or indirectly connect the inner casing 310 and the outer casing 212.

The plurality of guides 422, 522 and 622 may be disposed between the inner casing 310 and the outer casing 212. That is, the plurality of guides 422, 522 and 622 may be disposed between the inner casing 310 and the outer casing 212 to partition the diffuser path 234.

The plurality of guides 422, 522 and 622 may extend along in the axial direction X of the impeller 220.

The plurality of guides 422, 522 and 622 may include an edge part 323 (referring to FIG. 6) which is located at an upper stream side of the diffuser path 234 in a flowing direction M of the air discharged from the impeller 220. The edge part 323 may be formed at one ends of the plurality of guides 422, 522 and 622 to face the entrance 234*a* of the diffuser path 234. The edge part 323 may connect the inner casing 310 and the outer casing 212. That is, the edge part 323 may connect the inner casing 310 and the outer casing 212, and may be formed at one ends of the plurality of guides 422, 522 and 622 facing the entrance 234*a* of the diffuser path 234. The plurality of vanes 421, 521, 621 and 721 may be formed above the edge parts 323 of the plurality of guides 422, 522 and 622. In other words, the plurality of vanes 421, 521, 621 and 721 may be disposed to be located on at least a part of the edge parts 323 of the plurality of guides 422, 522 and 622.

The plurality of guides 422, 522 and 622 may be formed to be inclined with respect to the axial direction X of the impeller 220. Specifically, the plurality of guides 422, 522 and 622 may be formed to be gradually inclined along the rotating direction R of the impeller R from the upper stream side of the diffuser path 234 in the flowing direction M of the air discharged from the impeller 220 toward the lower stream side of the diffuser path 234. That is, the plurality of guides 422, 522 and 622 may be formed to be gradually inclined along the rotating direction R of the impeller 220 from the entrance 234*a* of the diffuser path 234 in the flowing direction M of the air discharged from the impeller 220 toward the exit 234*b* of the diffuser path 234.

The plurality of blades 320, 420, 520, 620 and 720 may include a curved surface. At least a part of at least one side of the plurality of vanes 421, 521, 621 and 721 and the plurality of guides 422, 522 and 622 may include the curved surface.

Hereinafter, as illustrated in FIG. 8, an arrangement structure of the plurality of blades 320 in accordance with an embodiment of the disclosure will be described in detail.

The plurality of blades 320 may connect the inner casing 310 and the outer casing 212.

The plurality of vanes (not shown) may be located above the plurality of guides (not shown) in the axial direction X of the impeller 220, and the plurality of guides (not shown) may be located under the plurality of vanes (not shown) in the axial direction X of the impeller 220. In other words, the plurality of vanes (not shown) may be located on the edge parts 323 of the plurality of guides (not shown).

The plurality of vanes (not shown) and the plurality of guides (not shown) may be integrally formed. Specifically, the plurality of vanes (not shown) may be integrally formed with the plurality of guides (not shown) to be located on the edge parts 323.

The plurality of vanes (not shown) may be disposed at at least one of the inner casing 310 and the outer casing 212 to protrude upward in the axial direction X of the impeller 220. The plurality of vanes (not shown) may protrude upward in the axial direction X of the impeller 220 to face the shroud 211*b* of the first housing 211.

The plurality of vanes (not shown) may be installed on the frame 311 of the inner casing 310. That is, the plurality of vanes (not shown) may be installed on the frame 311 of the inner casing 310 to extend outward in the radial direction D of the inner casing 310.

The plurality of vanes (not shown) may be disposed to cross the entrance 234*a* of the diffuser path 234 outward in the radial direction D of the inner casing 310.

The plurality of vanes (not shown) may be disposed so that one ends of the plurality of vanes (not shown) are connected with the outer casing 212. That is, one ends of the plurality of vanes (not shown) may be connected to the outer casing 212, and the other ends of the plurality of vanes (not shown) may be connected to the frame 311 of the inner casing 310.

The plurality of guides (not shown) may be disposed in parallel with the axial direction X of the impeller 220.

Figure 9:
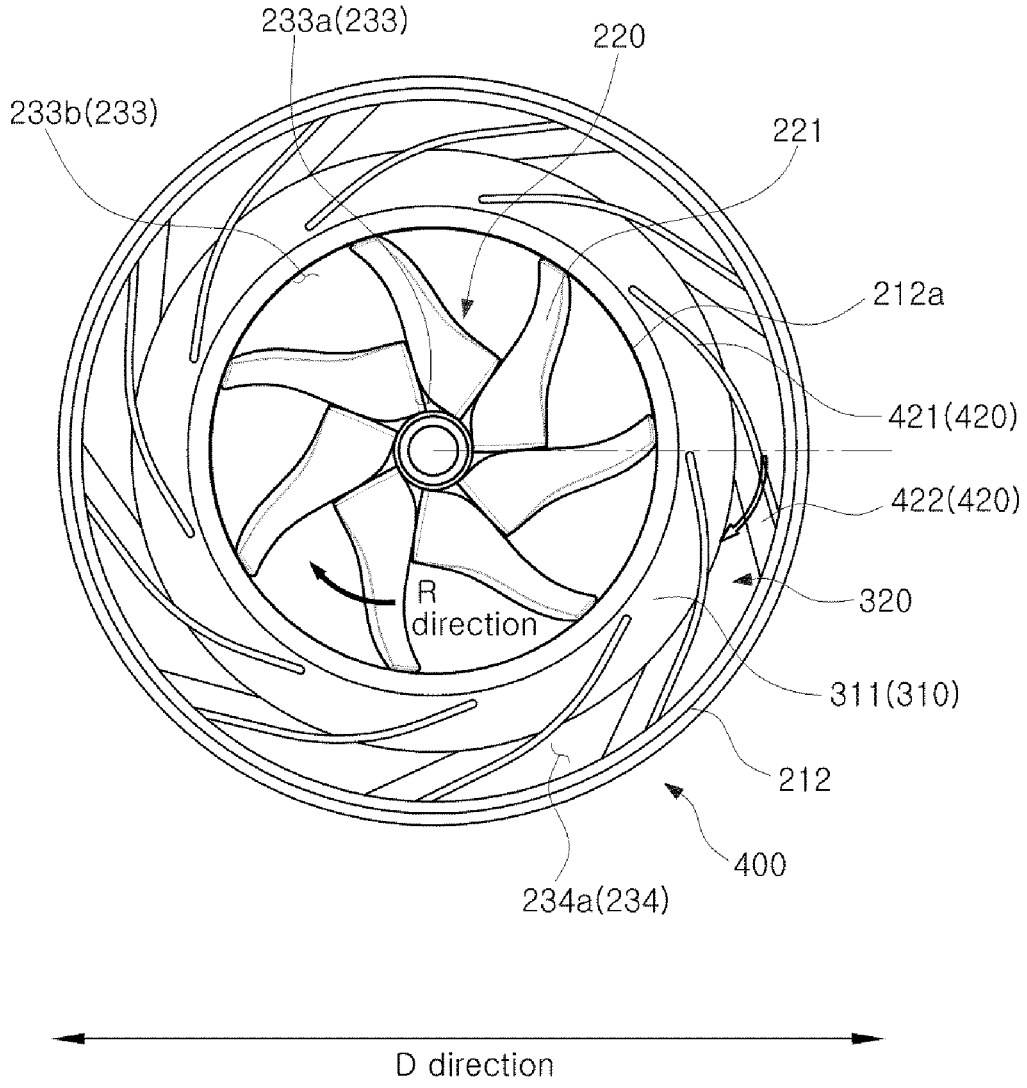
FIG. 9 is a view for explaining a second embodiment of the arrangement structure of the plurality of blades in the suction unit of the vacuum cleaner in accordance with an embodiment of the disclosure.

FIG. 9 is a view for explaining an embodiment of the arrangement structure of the plurality of blades in the suction unit of the vacuum cleaner in accordance with an embodiment of the disclosure. Hereinafter, reference numerals which are not described may correspond to those previously discussed with reference to FIGS. 1 to 8. Also, matters already described with reference to FIG. 8 may be omitted for the sake of brevity.

As illustrated in FIG. 9, the plurality of blades 420 may connect the inner casing 310 and the outer casing 212.

The plurality of vanes 421 may be located above the plurality of guides 422 in the axial direction X of the impeller 220, and the plurality of guides 422 may be located under the plurality of vanes 421 in the axial direction X of the impeller 220. In other words, the plurality of vanes 421 may be located on the edge parts 323 of the plurality of guides 422.

The plurality of vanes 421 may be integrally formed with the plurality of guides 422 to be located on the edge parts 323.

The plurality of vanes 421 may be disposed at at least one of the inner casing 310 and the outer casing 212 to protrude upward in the axial direction X of the impeller 220.

The plurality of vanes 421 may be installed on the frame 311 of the inner casing 310 to extend outward in the radial direction D of the inner casing 310.

One ends of the plurality of vanes 421 may be connected to the outer casing 212, and the other ends of the plurality of vanes 421 may be connected to the frame 311 of the inner casing 310.

At least a part of the plurality of vanes 421 may include a curved surface.

The plurality of guides 422 may be disposed to be inclined with respect to the axial direction X of the impeller 220. Specifically, the plurality of guides 422 may be disposed to be gradually inclined along the rotating direction R of the impeller 220 from the entrance 234*a* of the diffuser path 234 in the flowing direction M of the air discharged from the impeller 220 toward the exit 234*b* of the diffuser path 234. Since the plurality of guides 422 are disposed to be inclined with respect to the axial direction X of the impeller 220, the air introduced into the diffuser path 234 through the entrance 234*a* may flow more smoothly.

At least a part of the plurality of guides 422 may include the curved surface. As an example, at least a part of the plurality of guides 422 may include a concavely or convexly curved surface in the axial direction X of the impeller 220.

Figure 10A:
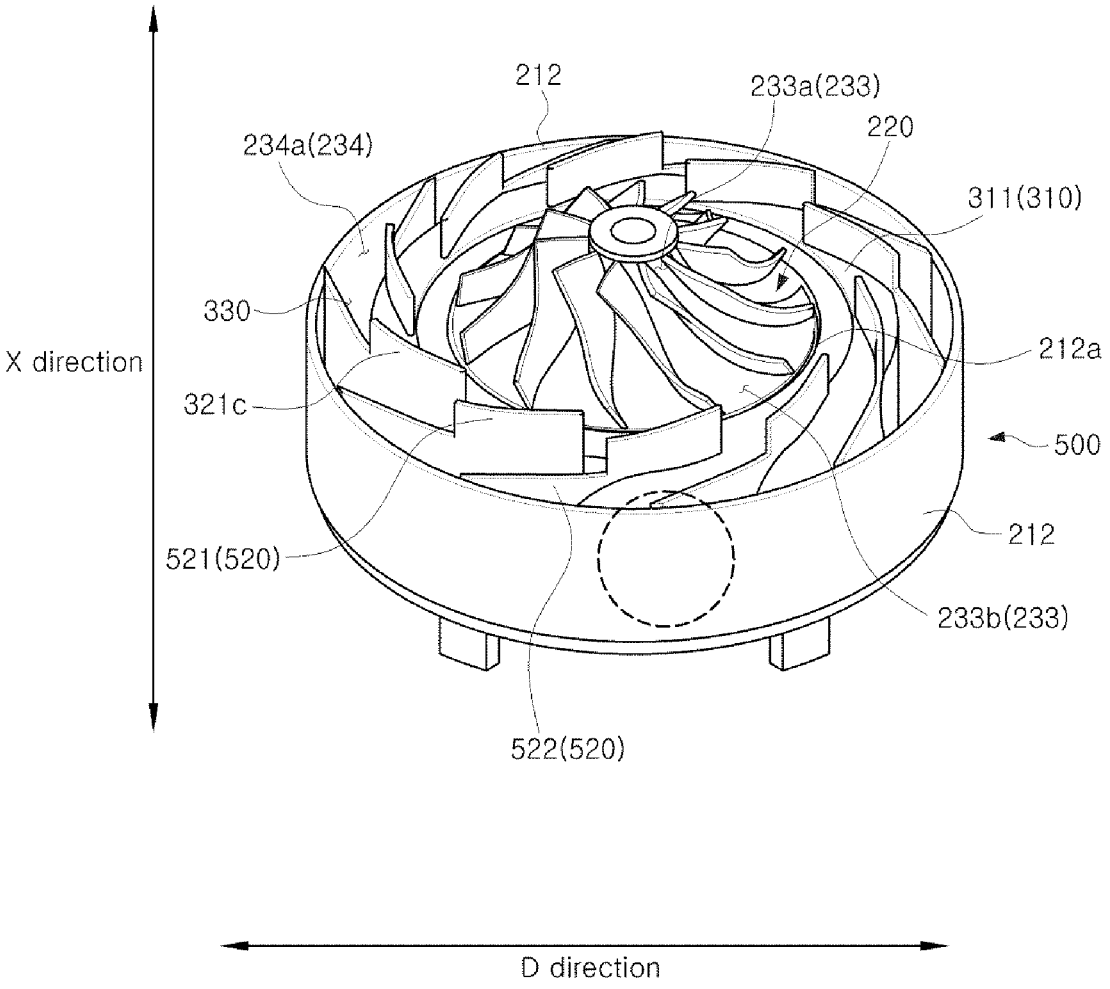
FIG. 10A is a view for explaining a third embodiment of the arrangement structure of the plurality of blades in the suction unit of the vacuum cleaner in accordance with an embodiment of the disclosure.
Figure 10B:
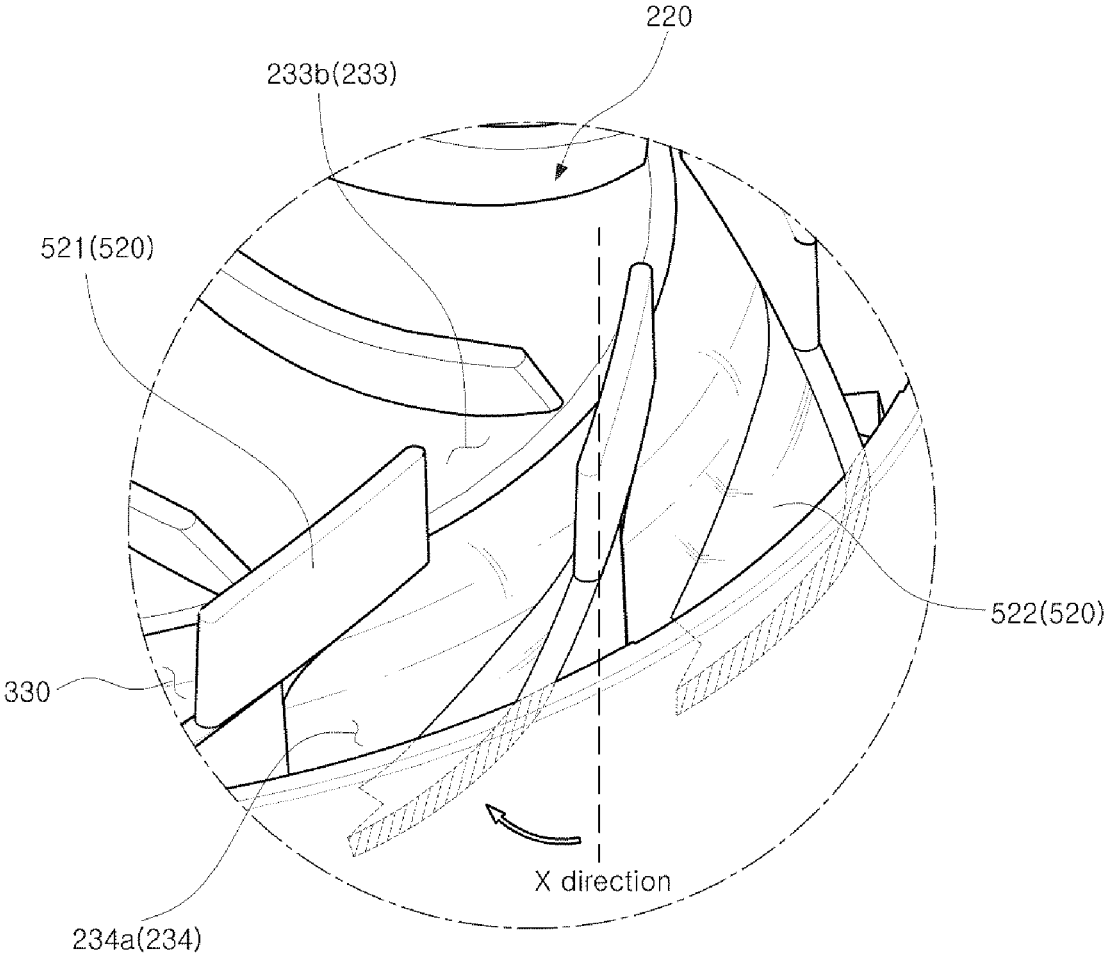
FIG. 10B is an enlarged view illustrating a part of FIG. 10A.

FIG. 10A is a view for explaining an embodiment of the arrangement structure of the plurality of blades in the suction unit of the vacuum cleaner in accordance with an embodiment of the disclosure, and FIG. 10B is an enlarged view illustrating a part of FIG. 10A. Hereinafter, reference numerals which are not described may correspond to those previously discussed with reference to FIGS. 1 to 8. Also, matters already described with reference to FIG. 8 may be omitted for the sake of brevity.

As illustrated in FIGS. 10A and 10B, the plurality of blades 520 may be provided between the inner casing 310 and the outer casing 212.

The plurality of vanes 521 may be located on the edge parts 323 of the plurality of guides 522 in the axial direction X of the impeller 220.

The plurality of vanes 521 may be integrally formed with the plurality of guides 522 to be located on the edge parts 323, for example, to have a substantially stepped-shaped appearance.

The plurality of vanes 521 may protrude upward in the axial direction X of the impeller 220 to face the shroud 211*b* of the first housing 211.

The plurality of vanes 521 may be disposed at at least one of the inner casing 310 and the outer casing 212.

The plurality of vanes 521 may be installed on the frame of the inner casing 310 to extend outward in the radial direction D of the inner casing 310.

The plurality of vanes 521 may include bodies 321*c* disposed between the inner casing 310 and the outer casing 212 in the radial direction D of the inner casing 310. The bodies 321*c* may be located on the edge part 323. Also, the bodies 321*c* may have a shape corresponding to the edge parts 323, but is not limited thereto.

The plurality of vanes 521 may be disposed to be spaced apart from the outer casing 212. That is, one ends of the plurality of vanes 521 facing the outside in the radial direction D of the inner casing 310 may be disposed to be spaced apart from the outer casing 212. The plurality of vanes 521 may be disposed on the edge parts 323 to be spaced apart from the outer casing 212.

Also, the plurality of vanes 521 may further include at least one communication part 330. The at least one communication part 330 may be formed at the plurality of vanes 521 located on the diffuser path 234, such that the air introduced into the diffuser path 234 passes therethrough. The at least one communication part 330 may be formed at the bodies 321*c*. That is, the at least one communication part 330 may be formed at the bodies 321*c* located on the diffuser path 234. The at least one communication part 330 may be formed at one ends of the plurality of vanes 521 which face the outside in the radial direction D of the inner casing 310 so that the plurality of vanes 521 are spaced apart from the outer casing 212. The at least one communication part 330 may have a hole shape, but is not limited thereto. The at least one communication part 330 may relieve a pressure of the air acting on at least one side of the plurality of vanes 521 and the plurality guides 522, and thus may enhance the suction performance of the suction unit 200. Also, the at least one communication part 330 may reduce noise generated from the suction unit 200.

At least a part of the plurality of vanes 521 may include a curved surface.

At least a part of the plurality of guides 522 may include the curved surface.

The plurality of guides 522 may be disposed to be gradually inclined along the rotating direction R of the impeller 220 from the entrance 234*a* of the diffuser path 234 in the flowing direction M of the air discharged from the impeller 220 toward the exit 234*b* of the diffuser path 234.

Figure 11A:
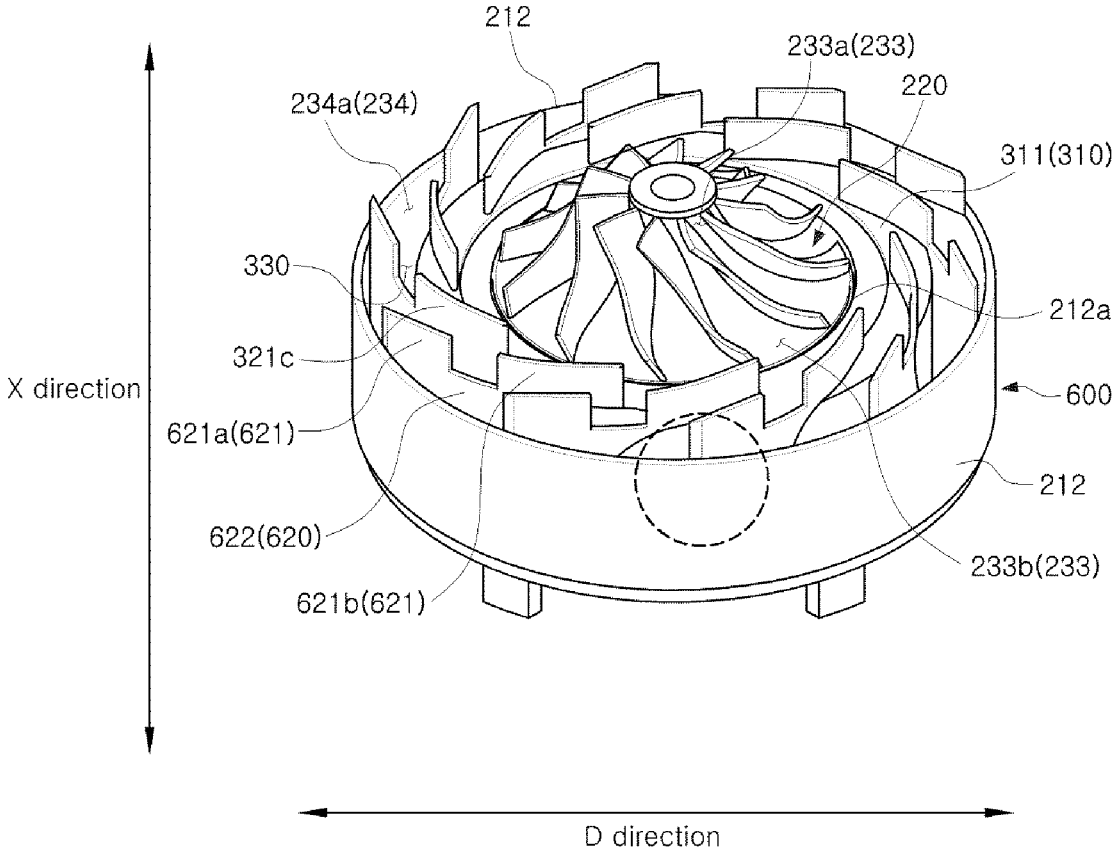
FIG. 11A is a view for explaining a fourth embodiment of the arrangement structure of the plurality of blades in the suction unit of the vacuum cleaner in accordance with an embodiment of the disclosure.
Figure 11B:
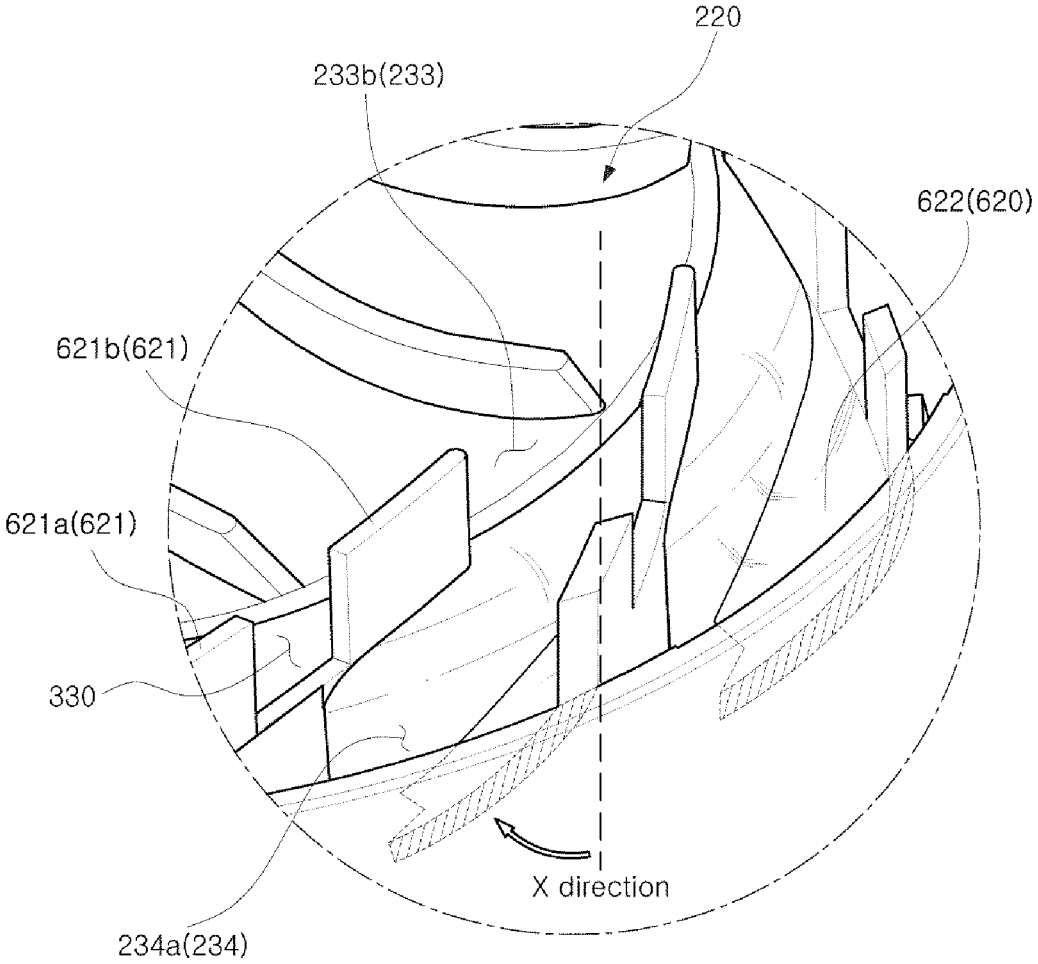
FIG. 11B is an enlarged view illustrating a part of FIG. 11A.

FIG. 11A is a view for explaining an embodiment of the arrangement structure of the plurality of blades in the suction unit of the vacuum cleaner in accordance with an embodiment of the disclosure, and FIG. 11B is an enlarged view illustrating a part of FIG. 11A. Hereinafter, reference numerals which are not described may correspond to those previously discussed with reference to FIGS. 1 to 10B. Also, matters already described with reference to FIGS. 10A and 10B may be omitted for the sake of brevity.

As illustrated in FIGS. 11A and 11B, the plurality of vanes 621 may be discontinuously disposed above the plurality of guides 622, for example, to have a substantially square wave shaped appearance. That is, the plurality of vanes may be disposed to be discontinuously located on the edge parts 323. In another aspect, at least one communication part 330 may be formed at inner sides of the bodies 321*c*.

When the plurality of vanes 621 are discontinuously disposed, the plurality of vanes 621 may include inner vanes 621*b* disposed at the inner casing 310 and outer vanes 621*a* disposed at the outer casing 212. The inner vanes 621*b* and the outer vanes 621*a* may face each other while the diffuser path 234 is interposed therebetween. In other words, the inner vanes 621*b* and the outer vanes 621*a* may be spaced apart from each other while the diffuser path 234 is interposed therebetween. The inner vanes 621*b* may be disposed on the frame 311 of the inner casing 310.

Figure 12:
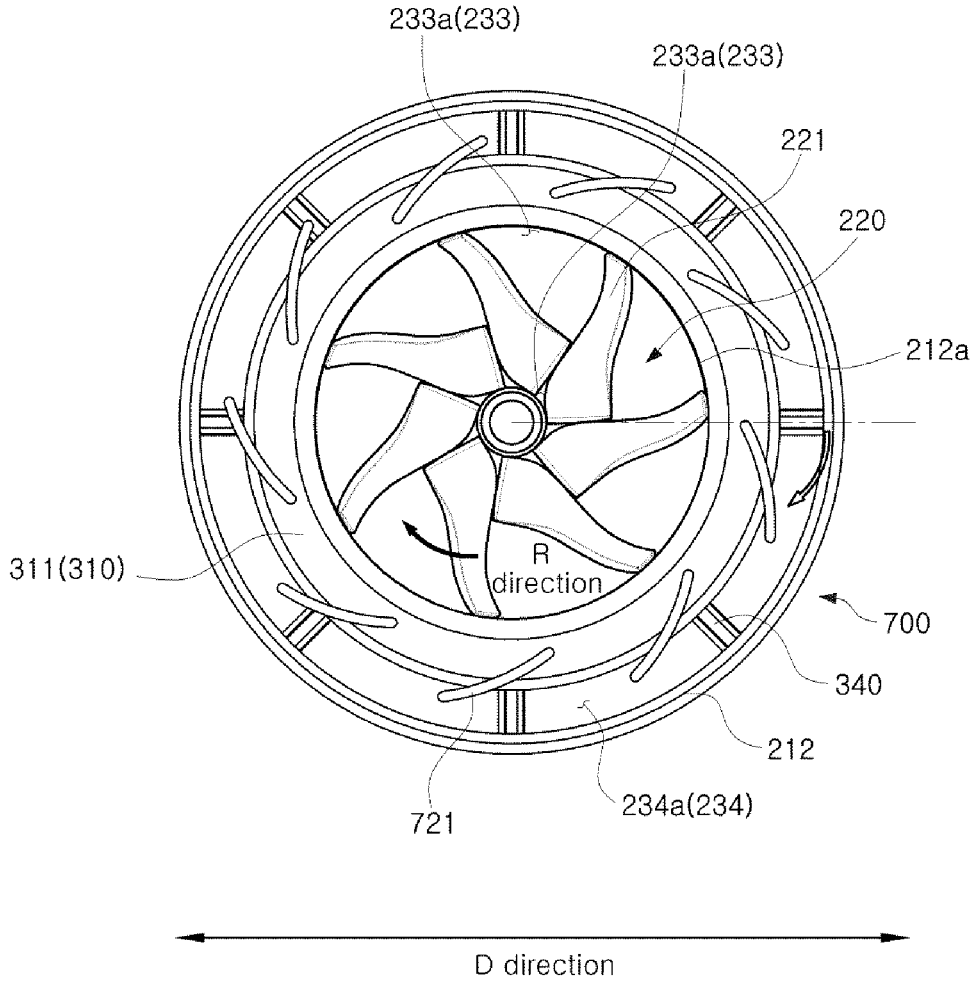
FIG. 12 is a view for explaining a fifth embodiment of the arrangement structure of the plurality of blades in the suction unit of the vacuum cleaner in accordance with an embodiment of the disclosure.

FIG. 12 is a view for explaining an embodiment of the arrangement structure of the plurality of blades in the suction unit of the vacuum cleaner in accordance with an embodiment of the disclosure. Hereinafter, reference numerals which are not described may correspond to those previously discussed with reference to FIGS. 1 to 11B. Also, matters already described with reference to FIG. 8 may be omitted for the sake of brevity.

As illustrated in FIG. 12, the plurality of blades 720 may include the plurality of vanes 721 and a plurality of bridges 340.

The plurality of bridges 340 may connect the inner casing 310 and the outer casing 212. Specifically, one ends of the plurality of bridges 340 may be connected to the inner casing 310 and the other ends of the plurality of bridges 340 may be connected to the outer casing 212. The plurality of bridges 340 may be provided between the inner casing 310 and the outer casing 212 and may serve to partition the diffuser path 234. The plurality of bridges 340 may be disposed along the circumference of the inner casing 310 to be spaced apart from each other.

The plurality of vanes 721 may be installed on the frame 311 of the inner casing 310. Specifically, the plurality of vanes 721 may be disposed on the frame 311 of the inner casing 310 to extend outward in the radial direction D of the inner casing 310. The plurality of vanes 721 may be disposed on the frame 311 to be located between the plurality of bridges 340 spaced apart from each other. That is, one ends of the plurality of vanes 721 facing outward in the radial direction D of the inner casing 310 may be located between the plurality of bridges 340 spaced from each other. However, the arrangement structure of the plurality of vanes 721 is not limited thereto, and the one ends of the plurality of vanes 721 facing outward in the radial direction D of the inner casing 310 may be located on the plurality of bridges 340.

The plurality of bridges 340 may be integrally formed with the inner casing 310 and the outer casing 212.

The plurality of vanes 721 may be integrally formed with at least one of the inner casing 310 and the outer casing 212.

The plurality of vanes 721 may be disposed to extend outward in the radial direction D of the inner casing 310. The plurality of vanes 721 may connect the air flowing path 233 and the diffuser path 234.

The shapes of the plurality of vanes 421, 521, 621 and 721 may be applied regardless of a kind of the motor. That is, FIGS. 1 to 12 have been described centering on a DC motor, but also may be applied to a BLDC motor, an AC motor or the like.

Figure 13:
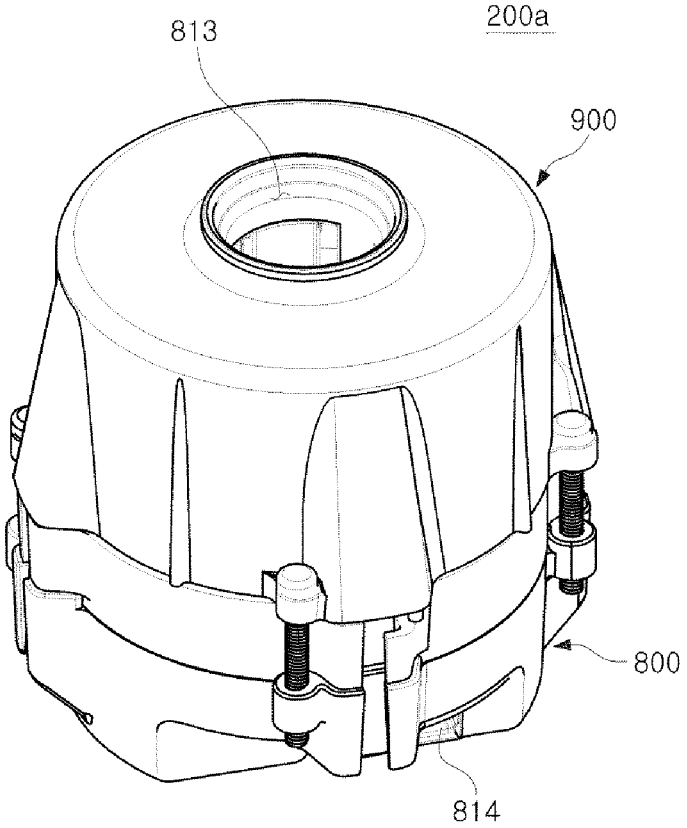
FIG. 13 is a perspective view illustrating a suction unit of the vacuum cleaner in accordance with an embodiment of the disclosure.
Figure 14:
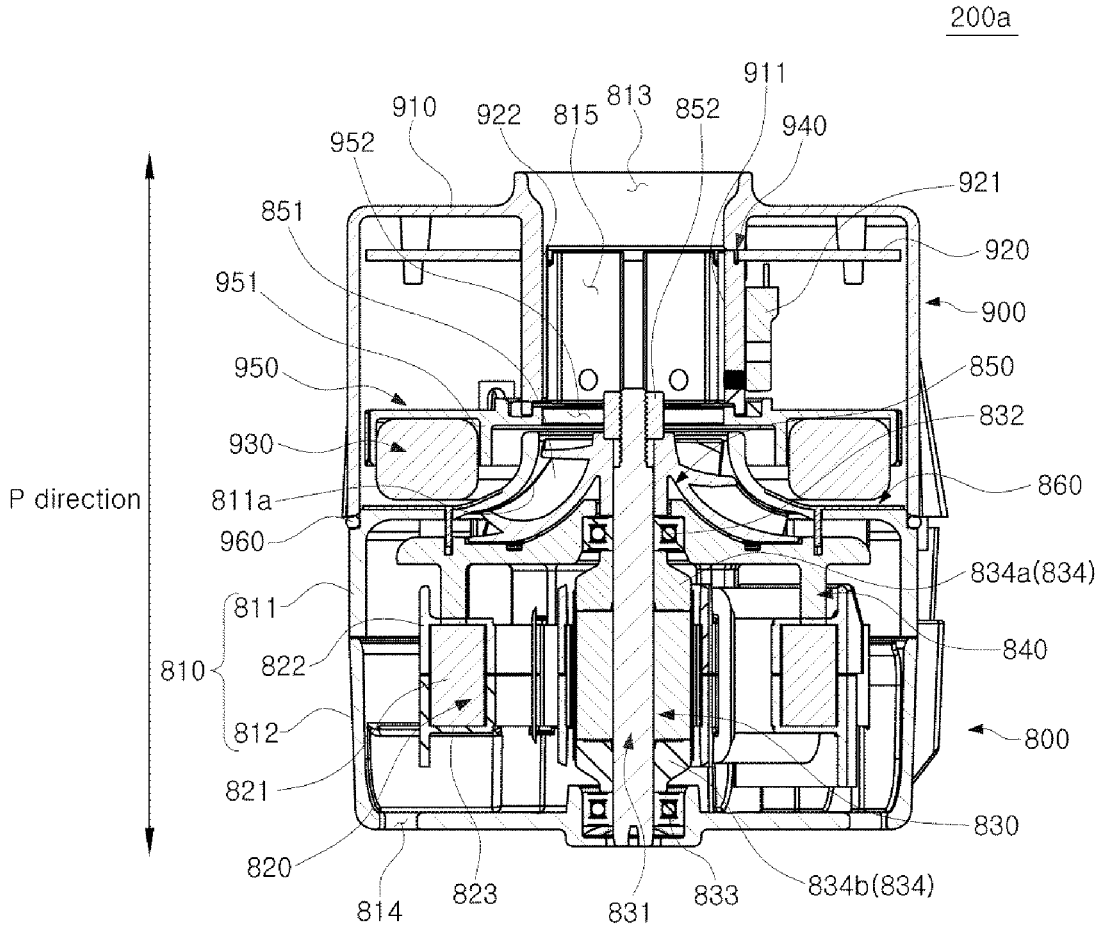
FIG. 14 is a cross-sectional view illustrating the suction unit of the vacuum cleaner in accordance with an embodiment of the disclosure.

FIG. 13 is a perspective view illustrating a suction unit of the vacuum cleaner in accordance with an embodiment of the disclosure, and FIG. 14 is a cross-sectional view illustrating the suction unit of the vacuum cleaner in accordance with an embodiment of the disclosure.

As illustrated in FIGS. 13 and 14, the suction unit 200*a* may include a motor assembly 800 and a controller assembly 900.

The motor assembly 800 may include a housing 810.

The housing 810 may form an exterior of the motor assembly 800.

The housing 810 may include an upper housing 811 which is located at an upper portion in an axial direction P of a motor shaft 831, and a lower housing 812 which is located at a lower portion in the axial direction P of the motor shaft 831. The upper housing 811 and the lower housing 812 may be coupled with each other to be detachable in the axial direction P of the motor shaft 831.

The upper housing 811 may include a shroud 811*a*.

The shroud 811*a* may be provided to correspond to an impeller 850 and thus to guide the air introduced into the suction unit 200*a*. The air introduced through an air inflow port 813 flows along an air path 815, and is discharged to an air outflow port 814 through the shroud 811*a*.

The air outflow port 814 may be provided at the lower housing 812. The air outflow port 814 may be provided at the lower housing 812 so that the air introduced through the air inflow port 813 is discharged therethrough.

A stator 820 and a rotor 830 may be disposed in the housing 810. The rotor 830 may be provided to be rotated by an electromagnetic interaction with the stator 820. The rotor 830 may be disposed in the stator 820.

The motor shaft 831 may be inserted into a center of the rotor 830 to be rotated with the rotor 830. One side of the motor shaft 831 may be rotatably supported by a bearing housing 840 via a first bearing 832, and the other side of the motor shaft 831 may be rotatably supported by the lower housing 812 via a second bearing 833.

The stator 820 may include a stator body 821, a first insulator 822, a second insulator 823 and a coil (not shown).

A rotor accommodating part (not shown) which accommodates the rotor 830 may be formed at a center portion of the stator body 821. The stator body 821 may be formed by stacking pressed steel plates.

A balancer 834 may be provided at the motor shaft 831. The balancer 834 serves to prevent the motor shaft 831 from being eccentrically rotated. The balancer 834 and the rotor 830 may be disposed up and down in the axial direction P of the motor shaft 831. Specifically, the balancer 834 may include a first balancer 834*a* disposed at an upper side of the rotor 830 in the axial direction P of the motor shaft 831 to prevent the eccentric rotation of the rotor 830, and a second balancer 834*b* disposed at a lower side of the rotor 830 in the axial direction P of the motor shaft 831. By such a structure, a center of mass of the rotor 830 at upper and lower sides of the motor shaft 831 centering on the rotor 830 may be close to the motor shaft 831, and thus the eccentric rotation of the motor shaft 831 and the rotor 830 may be prevented. However, a method of preventing the eccentric rotation of the motor shaft 831 and the rotor 830 is not limited thereto.

The motor assembly 800 may further include the impeller 850 and a diffuser 860.

The impeller 850 may be provided to be rotated with the motor shaft 831. The impeller 850 may be provided so that the air introduced in the axial direction P of the motor shaft 831 is discharged in a radial direction of the motor shaft 831 according to rotation of the impeller 850. That is, the impeller 850 may include a centrifugal fan. The impeller 850 may have a plurality of wings 851 which generate a flow of the air. A fixing member 852 which fixes the impeller 850 to prevent the impeller 850 from being separated may be provided at one end of the motor shaft 831. The shape and arrangement of the impeller 850 are not limited thereto.

The diffuser 860 serves to convert kinetic energy of the air sucked into the suction unit 200*a* into pressure energy by the impeller 850. In another aspect, the diffuser 860 serves to reduce a flow speed of the air flowing by the impeller 220. The diffuser 860 may be disposed to guide the air discharged from the impeller 850. The detailed shape and structure of the diffuser 860 will be described later.

The controller assembly 900 may be provided to control the motor assembly 800. The controller assembly 900 may be provided to be disposed at one side of the motor assembly 800.

The controller assembly 900 may include a controller housing 910 and a printed circuit board 920 which is provided in the controller housing 910.

The controller housing 910 may be provided to protect the printed circuit board 920 or a reactor 930 disposed therein. The air inflow port 813 through which the air is introduced may be provided at the controller housing 910. The air inflow port 813 may be provided to be in communication with the air path 815. The air inflow port 813 may be provided at the controller housing 910 to be located on the axial direction P of the motor shaft 831, but a position of the air inflow port 813 is not limited thereto.

The printed circuit board 920 may be provided in the controller housing 910 so as not to be exposed to an outside. The printed circuit board 920 may be provided to be fixed to an inner upper portion of the controller housing 910.

An electric element 921 may be mounted on the printed circuit board 920 to control the motor assembly 800. The printed circuit board 920 may have a through-hole 922 which corresponds to the air inflow port 813 and passes through the printed circuit board 920. The printed circuit board 920 may have an annular shape centering on the through-hole 922, but a shape of the printed circuit board 920 is not limited thereto. The printed circuit board 920 may be press-fitted and fixed to an inner surface 911 of the controller housing 910.

The controller assembly 900 may include a heat sink 940.

The heat sink 940 may radiate heat generated from the controller assembly 900, may enhance stability of a product, and may allow the suction unit 200*a* to be stably driven.

The heat sink 940 may be formed at the printed circuit board 920. Specifically, the heat sink 940 may be formed in a circumferential direction centering on the through-hole 922 of the printed circuit board 920. A plurality of heat sinks 940 may be provided to be spaced apart at regular (or irregular) intervals in the circumferential direction.

The heat sink 940 may define the air path 815 in which the air introduced through the air inflow port 813 flows. Specifically, the air path 815 may be formed by coupling one end of the heat sink 940 with one end of the shroud 811*a*. The air flowing through the air path 815 may be discharged to the air outflow port 814.

The controller assembly 900 may include the reactor 930.

The reactor 930 may be disposed in the controller housing 910. The reactor 930 may absorb a surge voltage or the like generated due to a sudden change in a current, and thus may protect the motor assembly 800 and the controller assembly 900.

The reactor 930 may be disposed to face the printed circuit board 920 formed in the annular shape. Also, the reactor 930 may be provided to be seated to a reactor seating part 950. The reactor seating part 950 may include a plurality of legs (not shown) which are disposed to be spaced apart in the circumferential direction of the printed circuit board 920 and to be fixed to the printed circuit board 920, and a seating groove 951 which is concavely formed in an annular shape so that the reactor 930 is seated thereto. Since the reactor 930 is formed in the annular shape, the seating groove 951 to which the reactor 930 is seated may also be formed in the annular shape. A hollow portion 952 may be provided at a center of the reactor seating part 950 so that the air path 815 passes therethrough.

The reactor 930 may be seated to the reactor seating part 950, and the reactor seating part 950 may be coupled to the printed circuit board 920, and thus an assembling of the reactor 930 and the printed circuit board 920 may be performed. Also since the printed circuit board 920 may be press-fitted and fixed to the inner surface 911 of the controller housing 910, the controller assembly 900 may be assembled as one module.

When the motor assembly 800 and the controller assembly 900 are coupled with each other, the reactor 930 may be disposed above the upper housing 811. At least one of a pad (not shown) and the diffuser 860 may be provided between the reactor 930 and the upper housing 811.

The pad serves to prevent noise due to vibration or shaking which may be generated by a gap between the reactor 930 and the upper housing 811. The pad may be formed of an insulating material so as to reduce the gap between the reactor 930 and the upper housing 811 and also to prevent an electrical effect on each other.

The diffuser 860 may be provided between the reactor 930 and the upper housing 811. The diffuser 860 may be disposed on an upper surface of the upper housing 811 in the axial direction P of the motor shaft 831. The diffuser 860 may pass through a coupling hole 816 (see FIG. 15) formed at the upper housing 811 and may be coupled to the bearing housing 840. The diffuser 860 may be formed of an insulating material so as to reduce the gap between the reactor 930 and the upper housing 811 and also to prevent the electrical effect on each other. A detailed coupling structure of the diffuser 860 will be described later.

The motor assembly 800 and the controller assembly 900 may be screw-coupled with each other. However, a coupling method between the motor assembly 800 and the controller assembly 900 is not limited thereto.

When the motor assembly 800 and the controller assembly 900 are coupled with each other, an o-ring 960 may be provided between the upper housing 811 and the controller housing 810. Specifically, the o-ring 960 may be disposed at a contact portion between the upper surface of the upper housing 811 and the inner surface of the controller housing 910 to prevent the air from being introduced into the suction unit 200*a* through the contact portion between the upper surface of the upper housing 811 and the inner surface of the controller housing 910. The o-ring 960 may have an annular shape. Also, the o-ring 960 may be formed of an elastic material.

Accordingly, the suction unit 200*a* has a structure in which the motor assembly 800 and the controller assembly 900 are detachably assembled. Therefore, when one of the motor assembly 800 and the controller assembly 900 is broken down, it is not necessary to disassemble or cut the entire suction unit 200*a*. Therefore, this structure is effective in maintenance of the suction unit 200*a*.

Figure 15:
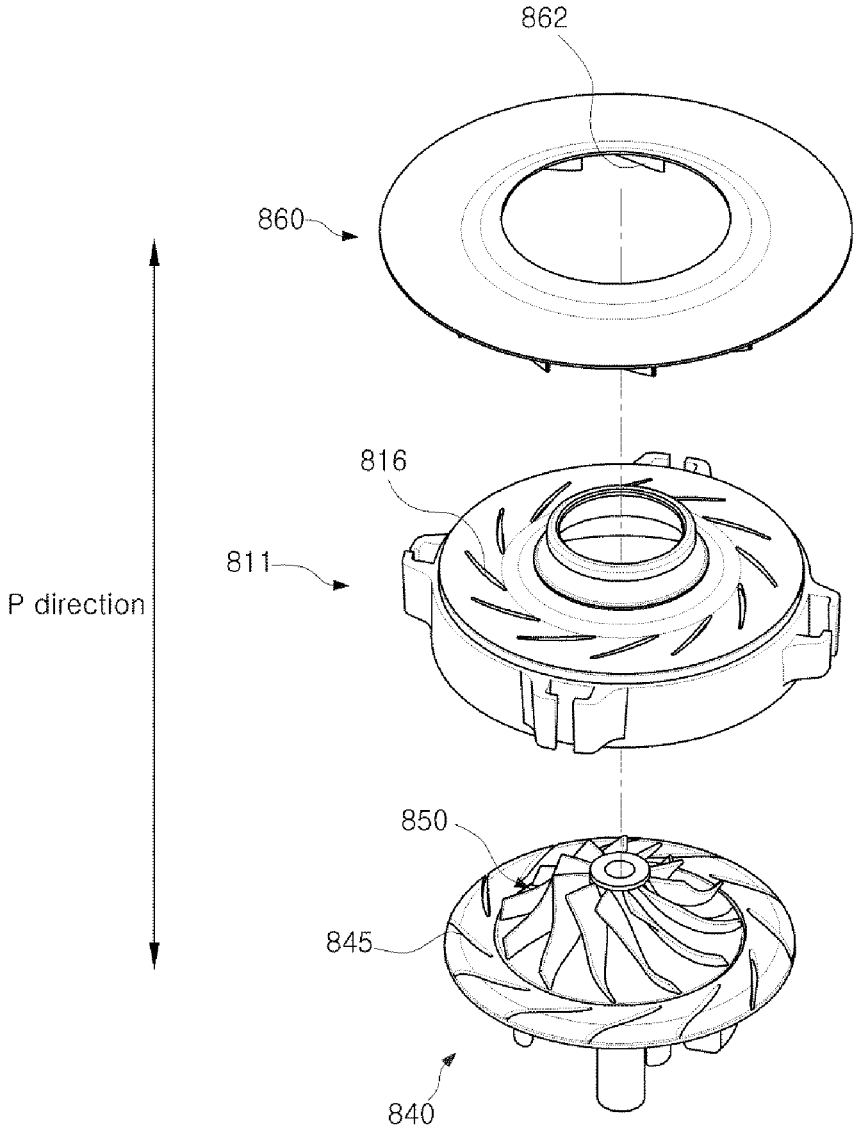
FIG. 15 is a view illustrating a diffuser assembling process in the suction unit of the vacuum cleaner in accordance with an embodiment of the disclosure.
Figure 16:
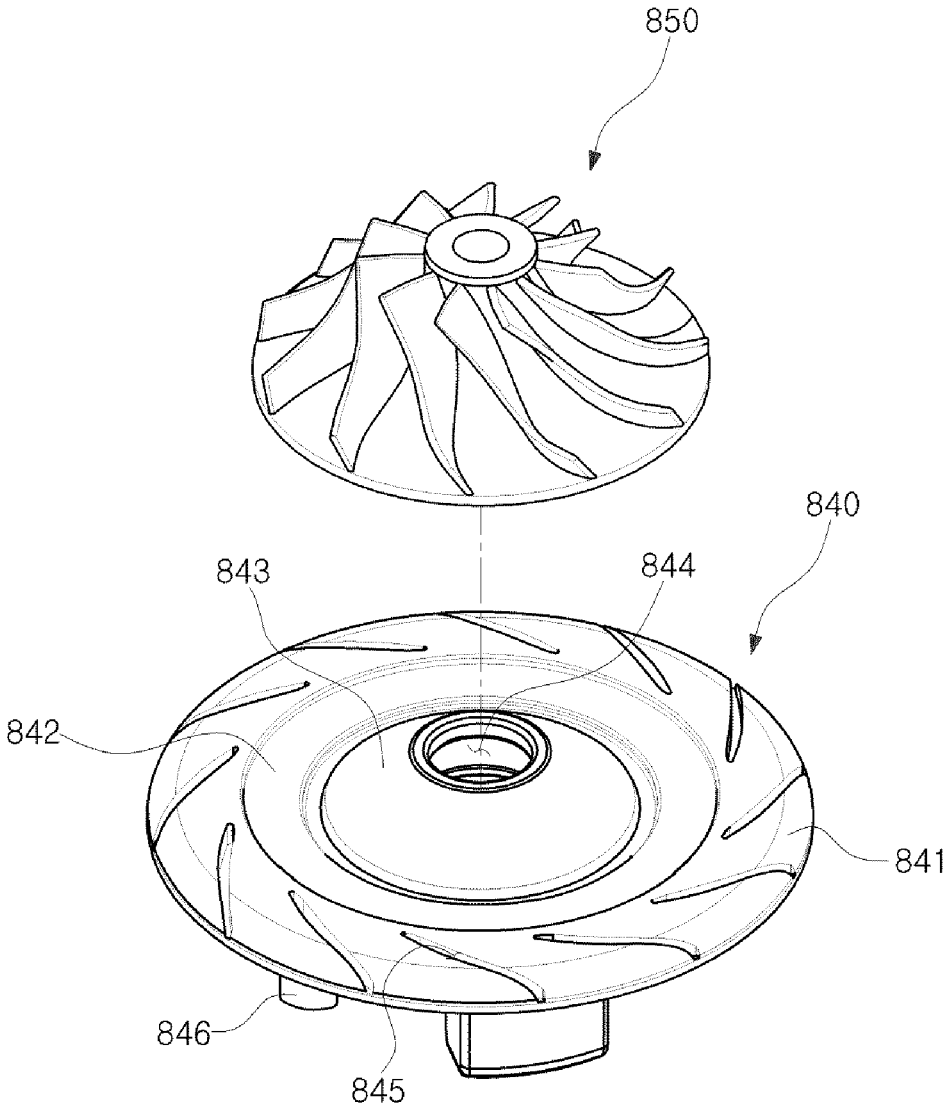
FIG. 16 is a view illustrating a bearing housing in the suction unit of the vacuum cleaner in accordance with an embodiment of the disclosure.
Figure 17A:
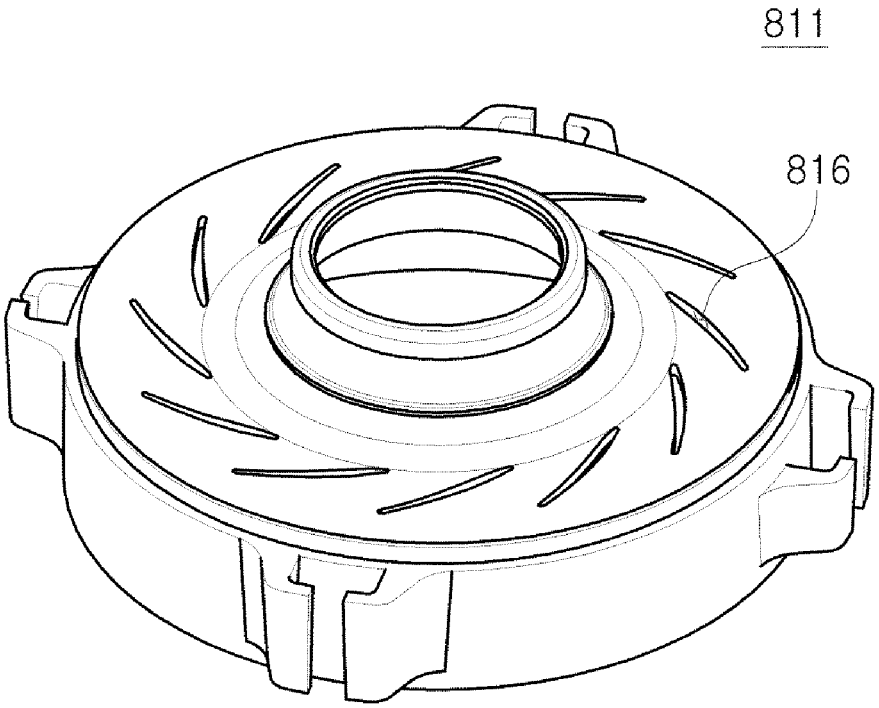
FIGS. 17A and 17B are views illustrating an upper housing in the suction unit of the vacuum cleaner in accordance with an embodiment of the disclosure.
Figure 17B:
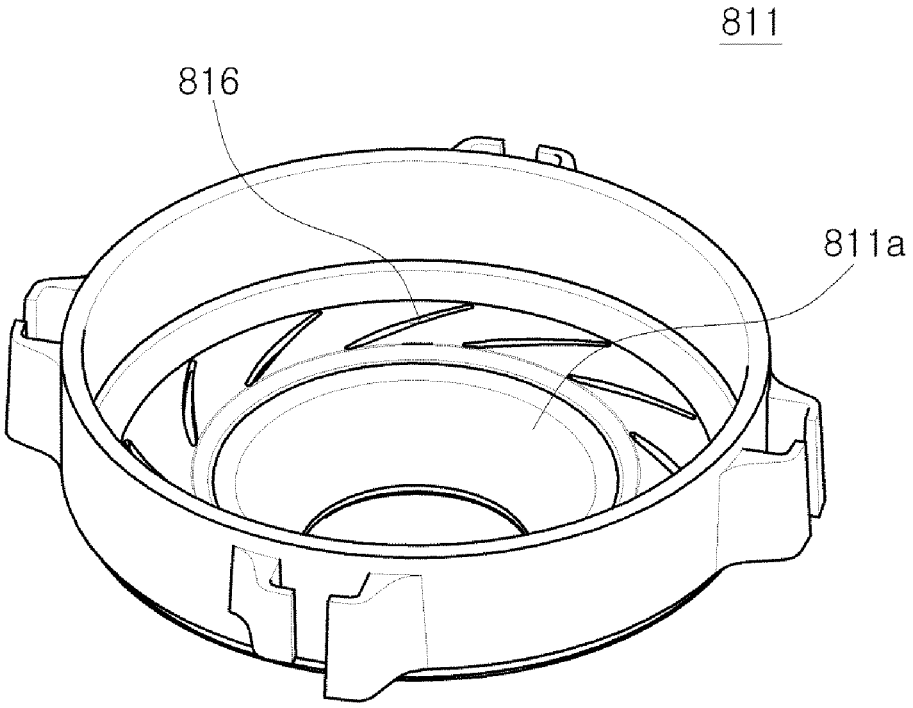
Figure 18A:
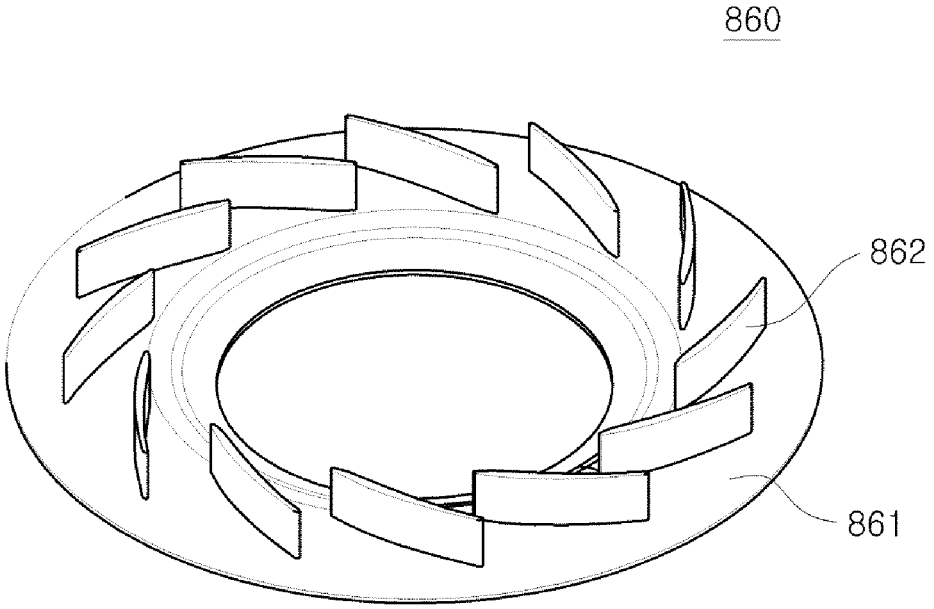
FIGS. 18A and 18B are views illustrating the diffuser in the suction unit of the vacuum cleaner in accordance with an embodiment of the disclosure.
Figure 18B:
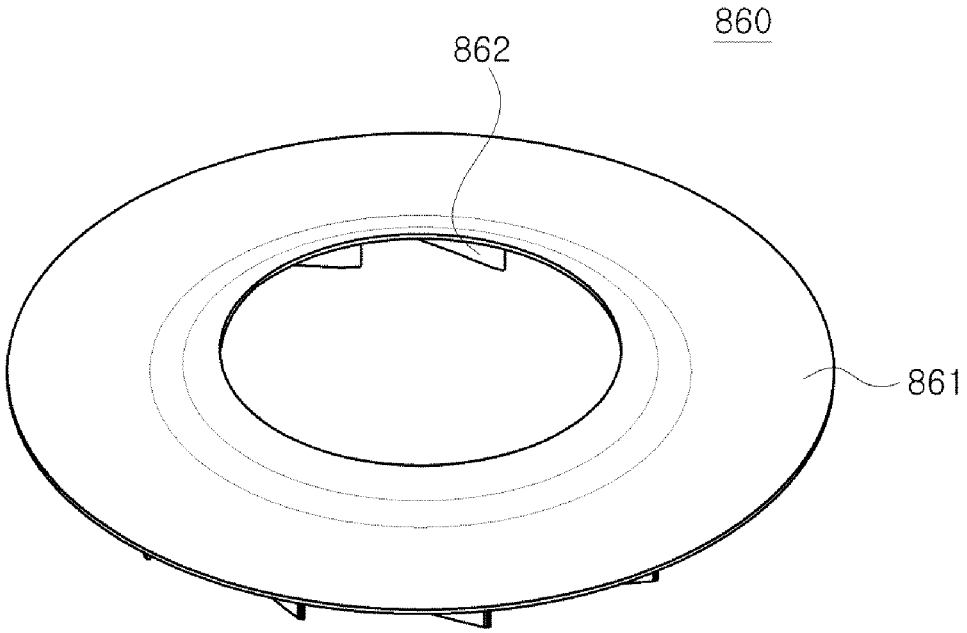

FIG. 15 is a view illustrating a diffuser assembling process in the suction unit of the vacuum cleaner in accordance with an embodiment of the disclosure, and FIG. 16 is a view illustrating the bearing housing in the suction unit of the vacuum cleaner in accordance with an embodiment of the disclosure. FIGS. 17A and 17B are views illustrating the upper housing in the suction unit of the vacuum cleaner in accordance with an embodiment of the disclosure, and FIGS. 18A and 18B are views illustrating the diffuser in the suction unit of the vacuum cleaner in accordance with an embodiment of the disclosure. Hereinafter, reference numerals which are not described may correspond to those previously discussed with reference to FIGS. 13 to 14. Also, matters already described with reference to FIGS. 13 and 14 may be omitted for the sake of brevity.

As illustrated in FIGS. 15 to 18B, the impeller 850 and the bearing housing 840 may be provided in the upper housing 811.

The impeller 850 and the bearing housing 840 may be provided in the upper housing 811 in the axial direction P of the motor shaft 831. The impeller 850 and the bearing housing 840 may be provided in the upper housing 811 to face each other in the axial direction P of the motor shaft 831. Alternatively, the impeller 850 and the bearing housing 840 may be provided in the upper housing 811 to be coupled with each other in the axial direction P of the motor shaft 831. Specifically, the impeller 850 may be provided in the upper housing 811 to be located at an upper side in the axial direction P of the motor shaft 831, and the bearing housing 840 may be provided in the upper housing 811 to be located at a lower side in the axial direction P of the motor shaft 831.

The bearing housing 840 may include a body 841.

The body may have a circular plate shape, but a shape of the body 841 is not limited thereto.

An impeller seating part 842 may be formed at the body 841 so that the impeller 850 is seated thereto. The impeller seating part 842 may be formed on an upper surface of the body 841. Specifically, the impeller seating part 842 may have a shape which is recessed downward in the axial direction P of the motor shaft 831, such that the impeller 850 is coupled or seated thereto.

The impeller seating part 842 may have a shape corresponding to a rear surface of the impeller 850. The impeller seating part 842 may include a peak part 843 which is convex upward, as being near the motor shaft 831, in the axial direction P of the motor shaft 831. The peak part 843 may have a slope. The slope of the peak part 843 may gradually decrease outward (i.e., become less steep) in a radial direction of the bearing housing 840. In other words, the slope of the peak part 843 lessens the further away from the motor shaft 831. The peak part 843 may have a substantially conical frustum shape, or a substantially parabolic frustum shape, for example. However, a shape of the impeller seating part 842 is not limited thereto, and may be changed depending on a shape of the rear surface of the impeller 850.

The impeller seating part 842 may have a hollow portion 844 provided so that the motor shaft 831 passes therethrough. The hollow portion 844 may be formed at the peak part 843. The hollow portion 844 may be formed at a center portion of the peak part 843, but a position of the hollow portion is not limited thereto.

The bearing housing 840 may further include a plurality of coupling grooves 845.

The plurality of coupling grooves 845 may be formed at the body 841.

The plurality of coupling grooves 845 may be formed on the upper surface of the body 841.

The plurality of coupling grooves 845 may be formed along a circumference of the body 841.

The plurality of coupling grooves 845 may be formed on the upper surface of the body 841 to be located at an outer side of the impeller seating part 842.

The plurality of coupling grooves 845 may be formed at a boundary of the body 841 to be located along a circumference of the impeller seating part 842.

The plurality of coupling grooves 845 may have a shape corresponding to a plurality of vanes 862 provided at the diffuser 860. Also, a number of coupling grooves 845 may correspond to a number of vanes 862 provided at the diffuser 860.

The diffuser 860 may be coupled with the bearing housing 840. Specifically, as the plurality of vanes 862 of the diffuser 860 are coupled to the plurality of coupling grooves 845 formed at the bearing housing 840, the diffuser 860 may be fixed or coupled to the bearing housing 840. The plurality of vanes 862 may be fitted to the plurality of coupling grooves 845, but a coupling method between the plurality of vanes 862 and the plurality of coupling grooves 845 is not limited thereto.

The bearing housing 840 may further include at least one leg 846. The at least one leg 846 may extend from the body 841 facing downward in the axial direction P of the motor shaft 831.

The bearing housing 840 may be coupled or fixed to the first insulator 822. Specifically, the at least one leg 846 of the bearing housing 840 may be fitted to an upper surface of the first insulator 822.

The bearing housing 840 may be formed of a metallic material having high thermal conductivity to enhance rigidity and heat radiation efficiency. As an example, the bearing housing may be formed of aluminum.

The diffuser 860 may be disposed on the upper surface of the upper housing 811 in the axial direction P of the motor shaft 831.

The diffuser 860 may include a platform 861 and the plurality of vanes 862 may be disposed at the platform 861.

The platform 861 may have a doughnut or annular shape, but is not limited thereto.

The diffuser 860 may be coupled to the plurality of coupling grooves 845 of the bearing housing 840 so that the plurality of vanes 862 face downward in the axial direction P of the motor shaft 831.

The platform 861 may be disposed on the upper surface of the upper housing 811 so that a gap is not formed between the platform 861 and the upper surface of the upper housing 811. Specifically, the platform 861 may be disposed on or coupled to the upper surface of the upper housing 811 so that a gap is not formed between the platform 861 and the upper surface of the upper housing 811.

The diffuser 860 may include or be formed of a plastic material. When the diffuser 860 is formed of an aluminum alloy for die-castings, the plurality of vanes 862 may be thick, and thus the plurality of thick vanes 862 may obstruct a flow of the air passing through the diffuser 860. On the other hand, when the diffuser 860 is formed of a plastic material, a thickness of each vane 862 may be easily adjusted, and thus the air passing through the diffuser 860 may flow smoothly. Also, when the diffuser 860 is formed of the plastic material, it is possible to solve an insulation problem with the reactor 930. Specifically, the reactor 930 may be disposed to face the platform 861. That is, the reactor 930 may be disposed above the platform 861 of the diffuser 860 coupled to the bearing housing 840 in the axial direction P of the motor shaft 831. Accordingly, when the diffuser 860 is formed of a metallic material, the insulation problem between the reactor 930 and the diffuser 860 may occur due to the arrangement structure of the reactor 930 and the diffuser 860. However, when the diffuser 860 is formed of the plastic material, the insulation problem between the reactor 930 and the diffuser 860 may be solved, even though the reactor 930 and the diffuser 860 may be directly in contact with each other.

The upper housing 811 may be disposed between the diffuser 860 and the bearing housing 840.

A plurality of coupling holes 816 may be formed at the upper housing 811.

The plurality of coupling holes 816 may be formed at the upper surface of the upper housing 811.

The plurality of coupling holes 816 may be formed to pass through the upper surface of the upper housing 811.

The plurality of coupling holes 816 may have shapes corresponding to the plurality of vanes 862 of the diffuser 860. Also, a number of coupling holes 816 may correspond to a number of vanes 862 provided at the diffuser 860.

The plurality of vanes 862 of the diffuser 860 may pass through the plurality of coupling holes 816 and then may be coupled to the plurality of coupling grooves 845 of the bearing housing 840. Therefore, the plurality of vanes 862, the plurality of coupling holes 816 and the plurality of coupling grooves 845 may be formed to have shapes and numbers corresponding to each other. Further, the plurality of vanes 862, the plurality of coupling holes 816 and the plurality of coupling grooves 845 may be formed at positions corresponding to each other. Since the plurality of vanes 862 may pass through the plurality of coupling holes 816 and then may be coupled to the plurality of coupling grooves 845, assemblability of the diffuser 860, the upper housing 811 and the bearing housing 840 may be enhanced. That is, in a process in which the diffuser 860 is coupled to the bearing housing 840, since the plurality of vanes 862 pass through the plurality of coupling holes 816 and then are coupled to the plurality of coupling grooves 845, an assembly of the diffuser 860, the upper housing 811 and the bearing housing 840 may be firmly maintained.

The diffuser 860 may be in close contact with the upper housing 811. The diffuser 860 and the upper housing 811 may be adhered, fastened, or welded to each other so as to enhance a sealing effect between the diffuser 860 and the upper housing 811.

An adhering of the diffuser 860 and the upper housing 811 may be performed by an adhesive. That is, adhesion or sealing between the plurality of vanes 862 and the plurality of coupling holes 816 may be enhanced using the adhesive.

The diffuser 860 and the upper housing 811 may be welded using thermal welding. That is, the thermal welding may be performed while the plurality of vanes 862 are inserted or coupled into the plurality of coupling holes 816 and thus the adhesion or sealing between the plurality of vanes 862 and the plurality of coupling holes 816 may be enhanced. However, a sealing method between the diffuser 860 and the upper housing 811 is not limited thereto.

Figure 19A:
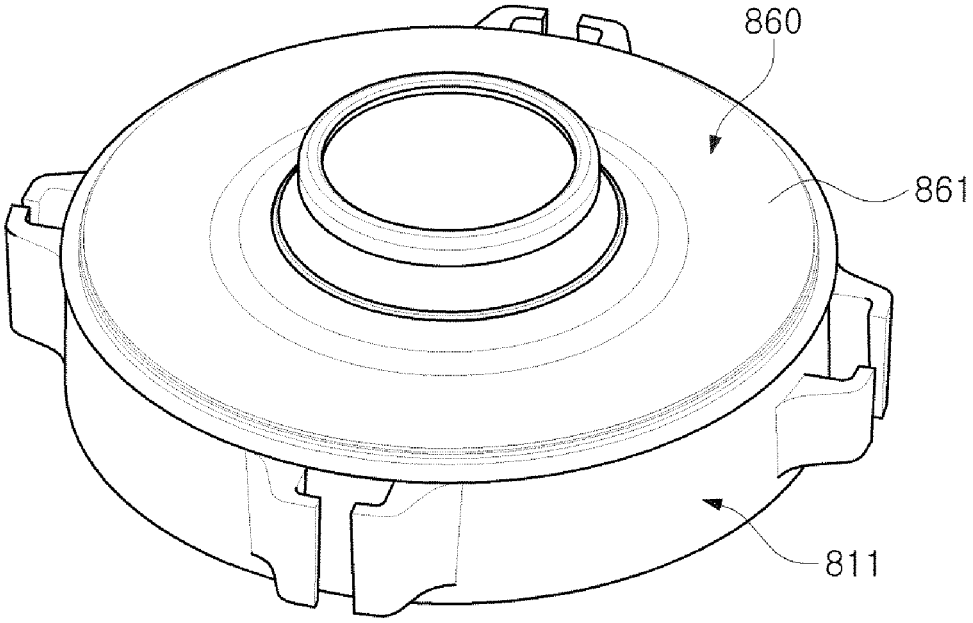
FIGS. 19A and 19B are view illustrating a diffuser and upper housing assembly formed by an insert injection molding in the suction unit of the vacuum cleaner in accordance with an embodiment of the disclosure.
Figure 19B:
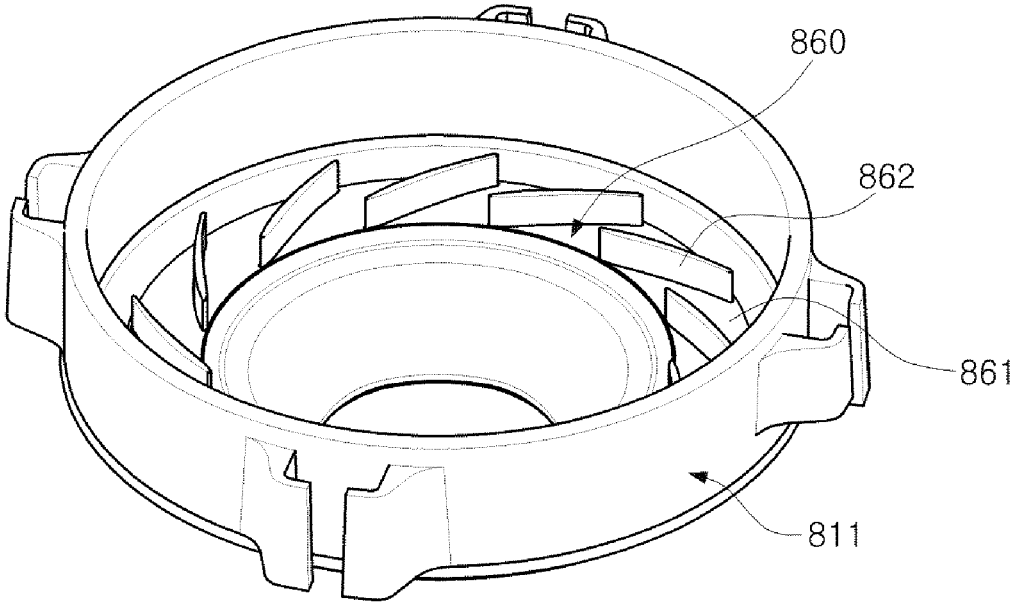

FIGS. 19A and 19B are views illustrating a diffuser and upper housing assembly formed by an insert injection molding in the suction unit of the vacuum cleaner in accordance with an embodiment of the disclosure. Hereinafter, reference numerals which are not described may correspond to those previously discussed with reference to FIGS. 13 to 18B.

As illustrated in FIGS. 19A and 19B, the diffuser 860 and the upper housing 811 may be formed integrally.

The diffuser 860 and the upper housing 811 may be formed integrally by insert injection molding. Specifically, the upper housing 811 formed of the metallic material may be manufactured, and then the diffuser 860 formed of the plastic material may be insert-injected, and thus the diffuser 860 and the upper housing 811 may be formed integrally. The metallic material of the upper housing 811 may include or be formed of aluminum.

An assembling method of the diffuser 860, the upper housing 811 and the bearing housing 840 may be variously applied, regardless of the kind of the motor. That is, FIGS. 13 to 19B have been described centering on an AC motor, but also may be applied to the BLDC motor, the DC motor or the like.

Since the plurality of vanes are disposed to extend outward in the radial direction of the inner casing, the length of the path through which the air discharged from the impeller flows may be sufficiently ensured, and thus the suction performance of the vacuum cleaner may be enhanced.

By extending lengths of the plurality of vanes, instead of enlarging a diameter of the inner casing or the outer casing, it may be expected to satisfy the small or compact size of the vacuum cleaner and also to enhance the suction force of the vacuum cleaner.

By forming at least one communication part at the plurality of vanes, it may be possible to reduce the noise generated from the vacuum cleaner.

By arranging the plurality of guides to be inclined with respect to the axial direction of the impeller, it may be possible to reduce path resistance.

By forming the coupling holes or coupling grooves at the upper housing and the bearing housing, it may be possible to enhance the assemblability of the diffuser.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A vacuum cleaner, comprising:

a main body; and a suction unit provided in the main body, the suction unit including:

an impeller configured to suck air by rotating about an axis thereof, a diffuser configured to guide air discharged from the impeller, the diffuser including:

an inner casing having a seating hole with a diameter greater than a diameter of the impeller, an outer casing having a continuous cylindrical wall and spaced apart from an outer circumference of the inner casing in a radial direction of the inner casing so as to form a path between the inner casing and the outer casing through which the air discharged from the impeller flows, and a plurality of vanes disposed at the inner casing configured to guide the air discharged from the impeller to the path, the plurality of vanes protruding toward the outer casing to cross at least a part of the path, and a motor module including a first seating housing to which the impeller is seated thereto, a second seating housing coupled to the first seating housing, and a motor disposed between the first seating housing and the second seating housing, wherein the plurality of vanes are disposed so that an outermost radial end of each of the plurality of vanes directly contacts the continuous cylindrical wall of the outer casing.

2. The vacuum cleaner according to claim 1, wherein the diffuser further includes a plurality of guides disposed on the path and provided between the inner casing and the outer casing.

3. The vacuum cleaner according to claim 2, wherein the plurality of guides connect the inner casing and the outer casing.

4. The vacuum cleaner according to claim 2, wherein the plurality of guides extend in an axial direction of the impeller.

5. The vacuum cleaner according to claim 4, wherein the plurality of guides are disposed to be inclined with respect to the axial direction of the impeller.

6. The vacuum cleaner according to claim 4, wherein the plurality of guides are disposed in parallel with the axial direction of the impeller.

7. The vacuum cleaner according to claim 2, wherein at least a part of the plurality of guides comprise a curved surface.

8. The vacuum cleaner according to claim 2, wherein the plurality of guides are integrally formed with the plurality of vanes and are located below the plurality of vanes in the axial direction of the impeller.

9. The vacuum cleaner according to claim 2, wherein the plurality of guides comprises edge parts located at an upper stream side of the path in a flowing direction of the air discharged from the impeller, and the plurality of vanes are disposed to be discontinuously located on the edge parts.

10. The vacuum cleaner according to claim 2, wherein the plurality of guides comprises edge parts located at an upper stream side of the path in a flowing direction of the air discharged from the impeller and are configured to connect the inner casing and the outer casing, and the plurality of vanes are disposed to be located on at least a part of the edge parts.

11. A vacuum cleaner, comprising:

a main body; and a suction unit provided in the main body, the suction unit including:

an impeller configured to suck air by rotating about an axis thereof, and a diffuser configured to guide air discharged from the impeller, the diffuser including:

an inner casing, an outer casing having a continuous cylindrical wall and spaced apart from an outer circumference of the inner casing in a radial direction of the inner casing, a path provided between the inner casing and the outer casing so that the air discharged from the impeller flows therethrough, and a plurality of blades formed integrally with at least one of the inner casing and the outer casing to connect the inner casing and the outer casing, wherein an outermost radial end of each of the plurality of blades directly contacts the continuous cylindrical wall of the outer casing, and a motor module including a first seating housing to which the impeller is seated thereto, a second seating housing coupled to the first seating housing, and a motor disposed between the first seating housing and the second seating housing.

12. The vacuum cleaner according to claim 11, wherein the plurality of blades comprise a plurality of vanes disposed on the inner casing to extend outward in a radial direction of the inner casing.

13. The vacuum cleaner according to claim 11, wherein the path comprises an entrance located at an upper stream side in a flowing direction of the air discharged from the impeller, and the plurality of blades comprises a plurality of vanes disposed to cross at least a part of the entrance.

14. The vacuum cleaner according to claim 11, wherein the plurality of blades comprises a plurality of vanes having bodies disposed between the inner casing and the outer casing in a radial direction of the inner casing, and at least one communication part is formed at the plurality of vanes.

15. The vacuum cleaner according to claim 14, wherein the at least one communication part is formed at the bodies located on the path so that air introduced into the path passes therethrough.

16. The vacuum cleaner according to claim 11, wherein the plurality of blades comprises a plurality of vanes disposed on the inner casing to protrude outward in the radial direction of the inner casing, and the plurality of vanes are gradually inclined along a rotating direction of the impeller from the inner casing toward the outer casing.

17. The vacuum cleaner according to claim 11, wherein the plurality of blades comprise a plurality of guides extended in an axial direction of the impeller to partition the path, and are coupled with the outer casing.

18. The vacuum cleaner according to claim 17, wherein the plurality of guides are gradually inclined along a rotating direction of the impeller from an upper stream side of the path in a flowing direction of the air discharged from the impeller to a lower stream side of the path.

19. The vacuum cleaner according to claim 11, wherein the plurality of blades comprises:

a plurality of vanes disposed on the inner casing to cross at least a part of the path in a radial direction of the inner casing; and a plurality of guides connected to the plurality of vanes in the axial direction of the impeller and disposed between the inner casing and the outer casing, and at least a part of at least one side of the plurality of vanes and the plurality of guides is formed with a curved surface.

20. A suction unit for a cleaning apparatus, the suction unit comprising:

a housing including:

a first housing in which an air inlet port is provided, a third housing in which an air outlet port is provided, and a second housing disposed between the first housing and the third housing in an axial direction, and including a plurality of coupling holes;

a motor assembly including:

a shaft, elongated in the axial direction and configured to rotate, and a bearing housing configured to rotatably support an upper portion of the shaft, an upper surface of the bearing housing including a plurality of coupling grooves;

an impeller coupled to the shaft and configured to suck air into the suction unit via the air inlet port; and a diffuser disposed about an outer circumference of the impeller, the diffuser comprising:

an inner casing, an outer casing, a diffuser path formed between the inner casing and the outer casing and through which air discharged from the impeller flows, and a plurality of blades which extend from one of the inner casing and the outer casing toward the other one of the outer casing and the inner casing, to cross at least a part of the diffuser path in a radial direction of the inner casing, and at least a part of each of the plurality of the blades extends through respective coupling holes of the second housing and is coupled with the respective coupling grooves of the upper surface of the bearing housing.

21. The suction unit of claim 20, wherein the air inlet port is disposed at an upper portion of the first housing, and the air outlet port is disposed at a lower portion of the third housing.

22. The suction unit of claim 21, wherein:

the second housing corresponds to the outer casing of the diffuser.

23. The suction unit of claim 20, wherein:

the second housing is configured to be coupleable to and detachable from at least one of the first housing and the third housing, and is disposed at the upper portion of the shaft between the diffuser and the bearing housing, the third housing is disposed at a lower portion of the shaft, and the diffuser is formed of plastic.

* * * * *